US009566818B2

(12) United States Patent
Kamitani et al.

(10) Patent No.: US 9,566,818 B2
(45) Date of Patent: Feb. 14, 2017

(54) WRITING INSTRUMENT

(71) Applicant: MITSUBISHI PENCIL COMPANY, LIMITED, Shinagawa-ku, Tokyo (JP)

(72) Inventors: Toshimi Kamitani, Fujioka (JP); Hiroyuki Okuyama, Fujioka (JP); Mitsuhiro Kawabata, Fujioka (JP); Tadashi Kouriki, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/816,314

(22) Filed: Aug. 3, 2015

(65) Prior Publication Data

US 2015/0367672 A1 Dec. 24, 2015

Related U.S. Application Data

(63) Continuation-in-part of application No. 13/698,200, filed as application No. PCT/JP2011/063609 on Jun. 14, 2011, now Pat. No. 9,132,692.

(30) Foreign Application Priority Data

Jun. 14, 2010 (JP) ..... 2010-134934
Jun. 10, 2011 (JP) ..... 2011-130310
(Continued)

(51) Int. Cl.
*B43K 5/00* (2006.01)
*B43K 8/06* (2006.01)
(Continued)

(52) U.S. Cl.
CPC . *B43K 8/06* (2013.01); *B43K 8/02* (2013.01); *B43K 8/026* (2013.01); *B43K 8/04* (2013.01); *B43K 1/06* (2013.01)

(58) Field of Classification Search
CPC ..... B43K 8/02; B43K 8/022; B43K 8/024; B43K 8/026; B43K 8/04; B43K 1/06
(Continued)

(56) References Cited

U.S. PATENT DOCUMENTS 3,397,938 A 8/1968 Juelss
6,409,408 B2 6/2002 Koyama
(Continued)

FOREIGN PATENT DOCUMENTS

CN 1652948 A 8/2005
JP 10-166778 A 6/1998
(Continued)

OTHER PUBLICATIONS

Notification of First Office Action dated May 10, 2016 issued in the corresponding Chinese Patent Application No. 201510504695.1 and English language translation (16 pages).
(Continued)

*Primary Examiner* — Jennifer C Chiang
(74) *Attorney, Agent, or Firm* — Buchanan, Ingersoll & Rooney PC

(57) ABSTRACT

In order to provide a writing instrument applicable to an applicator, in which a writing or applying direction can be visually recognized in a broad range at a visual part of a tip, the writing instrument is endowed with a constitution in which a tip is equipped with a porous member as a writing part and a holding member holding the above porous member and having at least one liquid guiding part for feeding an liquid to the writing or applying part, which comprises a relay porous member for feeding a liquid contained in a instrument main body to the liquid guiding part provided in the holding member 55 and in which the holding member is
(Continued)

a visible part wherein an area ratio of the above visible part on the front or side face is 40% or more of the tip protruding from a tip part.

2 Claims, 29 Drawing Sheets

(30) Foreign Application Priority Data

Jun. 10, 2011 (JP) ..... 2011-130311
Jun. 10, 2011 (JP) ..... 2011-130312

(51) Int. Cl.
*B43K 8/02* (2006.01)
*B43K 8/04* (2006.01)
*B43K 1/06* (2006.01)

(58) Field of Classification Search
USPC ..... 401/198, 199
See application file for complete search history.

(56) References Cited

U.S. PATENT DOCUMENTS

| | | | |
|---|---|---|---|
| 6,659,672 | B1 | 12/2003 | Kirita |
| 8,684,617 | B2 | 4/2014 | Koyama |
| 2005/0013651 | A1 | 1/2005 | Bedhome |
| 2005/0232685 | A1 | 10/2005 | Koyama |
| 2007/0248401 | A1 | 10/2007 | Noguchi |
| 2009/0317172 | A1 | 12/2009 | Bedhome et al. |
| 2010/0074672 | A1 | 3/2010 | Koyama |

FOREIGN PATENT DOCUMENTS

| | | | | | |
|---|---|---|---|---|---|
| JP | 11-078354 | A | | 3/1999 | |
| JP | 2000-052682 | A | | 2/2000 | |
| JP | 2000-127672 | A | | 5/2000 | |
| JP | 2001-096968 | A | | 4/2001 | |
| JP | 2001-253193 | A | | 9/2001 | |
| JP | 2001292829 | A | * | 10/2001 | |
| JP | 2002-019370 | A | | 1/2002 | |
| JP | 2005-246606 | A | | 9/2005 | |
| JP | 2005-324336 | A | | 11/2005 | |
| JP | 2006-256045 | A | | 9/2006 | |
| JP | 2007-069426 | A | | 3/2007 | |
| JP | 2007-069427 | A | | 3/2007 | |
| JP | 2010-089383 | A | | 4/2010 | |
| JP | FR 3017050 | A1 | * | 8/2015 | ..... A61K 8/0241 |
| WO | WO 03/044104 | A1 | | 5/2003 | |
| WO | WO 03/051648 | A1 | | 6/2003 | |
| WO | WO 2006/007775 | A1 | | 1/2006 | |

OTHER PUBLICATIONS

International Search Report (PCT/ISA/210) issued on Aug. 2, 2011, by the Japanese Patent Office as the International Searching Authority for International Application No. PCT/JP2011/063609.

Notification of Transmittal of Translation of the International Preliminary Report on Patentability (Forms PCT/IB/338 and PCT/IB/373) and the Written Opinion of the International Searching Authority (Form PCT/ISA/237) dated Jan. 24, 2013, issued in corresponding International Application No. PCT/JP2011/063609 (7 pages).

Extended European Search Report issued on Oct. 17, 2013, by the European Patent Office in corresponding European Patent Application No. 11795742.3-1704. (3 pages).

* cited by examiner

WRITING INSTRUMENT

This is a continuation-in-part of application Ser. No. 13/698,200 filed on Nov. 15, 2012, which was the National Stage of International Application No. PCT/JP2011/063609 filed on Jun. 14, 2011.

BACK GROUND OF THE INVENTION

1. Field of the Invention

The present invention relates to a writing instrument of a type called an underline marker in which an ink in a writing instrument main body is fed to a writing part of a tip, more specifically to a writing instrument in which a writing direction can be visually recognized in a broad range at a visual part of a tip and which can surely write to end of writing. The writing instrument of the present invention is applicable to also an applicator of the cosmetic liquid having a viscosity of 1 to 15 mPa·s.

2. Description of Related Art

Writing instruments of the respective structures (refer to, for example, patent documents 1 to 5 filed by the present applicant) have so far been known as writing instruments in which a writing direction can be visually recognized at a visual part of a pen tip. Among the above respective patent documents, known as a technique close to that of the present invention is, for example, a writing instrument 1 (refer to, for example, the patent document 1 filed by the present applicant) comprising, as shown in FIG. 25, a pen body 1*b* which guides an ink supplied from a writing instrument main body 1*a* and which can reserve it, wherein the pen body 1*b* described above is equipped with an ink guiding part 1*c* and a writing part 1*d* for delivering the ink from the above ink guiding part 1*c*, and it is equipped as well with a visible part 1*e* in which a writing direction can be visually recognized right above a holder direction of the above writing part 1*d*. In particular, the respective pen bodies shown in FIG. 26 and FIG. 27 disclose techniques closest to that of the present invention.

FIGS. 26A and 26B are drawings of the sixth embodiment of a pen body in the writing instrument described in patent document 1 described above. The pen body 2 of the above embodiment is endowed with a structure in which a writing part 2*c* fixed by a leg part 2*b* is provided at a front end of a transparent supporting member 2*a* and in which provided is an ink guiding part 2*d* comprising an ink guiding groove communicating with a rear end of the leg part 2*b* in the above writing part 2*c* and enabling to guide the ink to a prescribed part in an inside of the supporting member 2*a* described above by a capillary action. Since the supporting member 2*a* is constituted by a transparent resin and the like, a part 2*e* becomes a visible part, and a writing direction is visually recognized through an ink flowing in an inside of the supporting member 2*a*.

Also, FIGS. 27A and 27B show the eighth embodiment of a pen body in the writing instrument described in patent document 1 described above. The pen body 3 of the above embodiment has almost the same structure as that of the pen body of the sixth embodiment in FIG. 26 described above, and a different point thereof resides in a structure in which a window part 3*b* as a visible part is provided in a supporting member 3*a*, in which an ink guiding groove 3*c* is formed bypassing the above window part 3*b* and in which an ink can be fed to a writing part 3*d* by a capillary action.

However, in the writing instrument described in patent document 1 described above, taken is a structure in which the ink guiding parts 1*c*, 3*c* are provided at both sides of the visible parts 1*e*, 3*b* in FIG. 25 and FIG. 27 and in which the writing parts 1*d*, 3*d* are provided at a lower part thereof, and therefore an area ratio of the visible part 1*e* having visibility is actually a level of 30% of the pen tip (pen body) protruding from a tip part of the writing instrument main body. Accordingly, a problem is involved in the point that the satisfactory visibility cannot be secured and that it is a little difficult to see the writing direction. If the visible part is enlarged, visibility in the writing direction is broadened, but the writing part is enlarged as well, so that the writing performances as a line marker are damaged.

Also, in the pen body 2 shown in FIG. 26, a writing direction is visually recognized through an ink flowing through an inside of the supporting member 2*a*, and therefore a problem is involved in the point that it is difficult to see the writing direction when the ink has a deep color. Further, the leg part 2*b* fixed in an inside of the supporting member 2*a* does not have visibility, and therefore an area ratio of the visible part having visibility is actually a level of 30% of the pen tip (pen body) protruding from a tip part of the writing instrument main body. Accordingly, the satisfactory visibility cannot be secured, and the existing situation is that a pen body having a structure in which a writing direction can further widely be visually recognized is desired.

On the other hand, known as a writing instrument of an ink exhaustion detecting system in which a part of a writing direction in a back of the writing part can be visually recognized and in which an exhaustion sign of an ink can be detected are, for example, a writing instrument 4 of an ink exhaustion detecting system in which as shown in FIGS. 28A and 28B, an ink impregnated in an ink occulusion body 4*b* in an inside of a barrel 4*a* is fed to a pen tip 4*e* of a writing part via a feed 4*c* and an ink guiding part 4*d* and in which an exhaustion sign of the ink in the ink occulusion body 4*b* is visually recognized in the ink guiding part 4*d* described above to thereby detect it, wherein the ink guiding part 4*d* described above comprises a visible part 4*f* capable of visually recognizing a writing direction and an ink guiding tube 4*g* at a side part of the above visible part 4*f* (refer to, for example, patent document 6 filed by the present applicant) and a writing instrument 5 of an ink exhaustion detecting system in which as shown in FIGS. 29A and 29B, an ink impregnated in an ink occulusion body 5*b* in an inside of a barrel 5*a* is fed to a pen tip 5*e* as a writing part via a feed 5*c* and an ink guiding part 5*d* and in which an exhaustion sign of the ink in the ink occulusion body 5*b* is visually recognized in the ink guiding part 5*d* described above to thereby detect the exhaustion sign, wherein the ink guiding part 5*d* described above comprises a tabular ink guiding part 5*g* provided with a slit ink passage 5*f* having a thickness of 0.01 to 1.0 mm in an inside thereof; a visible light transmittance of the ink guiding part 5*g* in filling the ink is 50% or more; and a writing direction directly under an axis direction of the above ink guiding part 5*g* can be visually recognized via the ink guiding part 5*g* (refer to, for example, patent document 7 filed by the present applicant).

However, in the writing instrument 4 shown in FIGS. 28A and 28B, the ink guiding tube 4*g* is thickened (enlarged) in order to surely detect the exhaustion sign, and therefore a little problem is involved in the point that the sufficiently high visibility cannot be secured. Further, the existing situation is that, it is not easy to secure a sealing property of the pen tip and obtain a structure in which the ink is exhausted to the end, due to a complicated shape of the ink guiding tube 4*g*.

Also, in the writing instrument 5 shown in FIGS. 29A and 29B, if the ink guiding part is reduced in a thickness to such an extent that the sufficiently high visibility can be secured, the ink flow amount cannot be secured. On the other hand, if the ink flow amount is intended to be secured, the sufficiently high visibility cannot be secured, and therefore the effective visible part is limited to make it difficult to secure the visibility.

Patent document 1: Japanese Patent Application Laid-Open No. 52682/2000 (claims, embodiments, FIG. 1, FIG. 11, FIG. 12 and others)

Patent document 2: Japanese Patent Application Laid-Open No. 253193/2001 (claims, embodiments, FIG. 1 and others)

Patent document 3: Japanese Patent Application Laid-Open No. 19370/2002 (claims, embodiments, FIG. 1 and others)

Patent document 4: Japanese Patent Application Laid-Open No. 246606/2005 (claims, embodiments, FIG. 1 and others)

Patent document 5: Japanese Patent Application Laid-Open No. 256045/2006 (claims, embodiments, FIG. 1 and others)

Patent document 6: Japanese Patent Application Laid-Open No. 69426/2007 (claims, embodiments, FIG. 1 and others)

Patent document 7: Japanese Patent Application Laid-Open No. 69427/2007 (claims, embodiments, FIG. 1 and others)

SUMMARY OF THE INVENTION

In light of the problems on the conventional techniques described above, the present invention intends to solve them, and an object thereof is to provide a writing instrument applicable to a cosmetic applicator comprising a visible part and a liquid guiding part, wherein the visible part is provided with a sufficiently high visibility enabling to read surely characters written toward a writing direction, and the writing instrument applicable to an applicator can be used to end of writing or applying, and another object is to provide a writing instrument in which a sufficiently high writing flow amount can be secured to end of writing without damaging visibility and which is easy to write and excellent in productivity and durability. Further, an object thereof is to provide a writing instrument in which an ink flow amount is secured to prevent blurring in writing and stabilize a writing flow amount and in which an ink stored in a liquid occulusion body can sufficiently be exhausted. Moreover, the provided writing instrument is applicable to a cosmetic applicator by replacing the ink with an appropriate cosmetic liquid such as an aqueous cosmetic, an oil-based cosmetic, and including an emulsified cosmetic thereof, having a certain range of viscosity.

Intense investigations repeated by the present inventors in order to solve the conventional problems described above have resulted in finding that the writing instruments which meet the objects described above are provided by a writing instrument in which a tip is equipped with a porous member as a writing part and a holding member holding the above porous member and having at least one liquid guiding part for feeding an ink to the writing part, which has a relay porous member for feeding an ink contained in a writing instrument main body to the liquid guiding part provided in the holding member described above and in which the holding member described above is a visible part enabling to visually recognize a writing direction, wherein a tip structure in which an area ratio of the above visible part is a specific value or more is set, and specific structures are set for an ink feeding mechanism, a structure of the liquid guiding part, a structure of the porous member as the writing part and an interfacial structure between the porous member as the writing part and the holding member. Thus, the present invention has come to be completed.

That is, the present invention resides in the following items (1) and (2).

(1) An applicator in which a tip is equipped with a porous member as an applying part and a holding member holding the above porous member and having at least one liquid guiding part for feeding a liquid to the applying part, which comprises a relay porous member for feeding a liquid contained in an applicator main body to the liquid guiding part provided in a central part of a longitudinal direction of the holding member and in which the holding member is a visible part enabling to visually recognize an applying direction, wherein an area ratio of the above visible part on a front face is 40% or more of the tip protruding from a tip part of the applicator main body, and an area ratio of the visible part on a side face of the holding member in the tip is 40% or more.

(2) The applicator as described in above item (1), wherein the liquid is a cosmetic composition having a viscosity of ranged from 1 to 15 mPa·s.

According to the present invention, provided is a writing instrument or an applicator which is endowed with a sufficiently high visibility making it possible to see toward a writing or an applying directions than ever and which can be used to end of writing or applying.

BRIEF DESCRIPTION OF THE DRAWINGS

FIG. 8A is a central vertical cross section; and FIG. 8B is a central lateral cross section.

FIG. 9A is a front view; FIG.

9B is a plan view; FIG. 9C is a left side view; FIG. 9D is a central vertical cross section; and FIG. 9E is a central lateral cross section.

FIG. 10A is a perspective drawing observed from a front side; FIG. 10B is a perspective drawing observed from a rear side; FIG. 10C is a left side view; FIG. 10D is a right side view; and FIG. 10E is a central vertical cross section.

FIG. 11A is a front view; FIG. 11B is a plan view; FIG. 11C is a left side view; FIG. 11D is a right side view.

FIG. 14A is a plan view; FIG. 14B is a front view; FIG. 14C is a left side view; FIG. 14D is a right side view; and FIG. 14E is a base view.

FIG. 15A is a front view; FIG. 15B is a plan view; FIG. 15C is a left side view; and FIG. 15D is a right side view.

FIG. 16A is a central lateral cross section; FIG. 16B is a base view; and FIG. 16C is a central lateral cross section.

FIG. 17A is a front view; FIG. 17B is a plan view; FIG. 17C is a left side view; FIG. 17D is a right side view; and FIG. 17E is a back view.

FIG. 18A is a perspective drawing observed from a front side; and FIG. 18B is a perspective drawing observed from a rear side.

FIG. 19A is a front view; FIG. 19B is a plan view; FIG. 19C is a left side view; and FIG. 19D is a right side view.

FIG. 20 is a front view showing a state in which the writing instrument is put as it is on a plane of a desk with a cap member turned downward.

FIG. 21A is a perspective drawing observed from a front side; 21B is a left side view; 21C is a central vertical cross section; and 21D is a central lateral cross section.

DETAILED DESCRIPTION OF THE PREFERRED EMBODIMENTS

The embodiments of the present invention shall be explained below in detail. Hereinafter, FIGS. 2A to 2C, FIGS. 3A to 3D, FIGS. 4A to 4D, FIGS. 5A and 5B, FIGS. 6A to 6D, FIGS. 7A and 7B, FIGS. 8A and 8B, FIGS. 9A to 9E, FIGS. 10A to 10E, FIGS. 11A to 11E, FIGS. 12A and 12B, FIGS. 14A to 14E, FIGS. 15A to 15D, FIGS. 16A to 16C, FIGS. 17A to 17E, FIGS. 18A and 18B, FIGS. 19A to 19D, FIGS. 21A to 21D, FIGS. 26A and 26B, FIGS. 27A and 27B, FIGS. 28A and 28B, and FIGS. 29A and 29B are referred to merely as FIG. 2, FIG. 3, FIG. 4, FIG. 5, FIG. 6, FIG. 7, FIG. 8, FIG. 9, FIG. 10, FIG. 11, FIG. 12, FIG. 14, FIG. 15, FIG. 16, FIG. 17, FIG. 18, FIG. 19, FIG. 21, FIG. 26, FIG. 27, FIG. 28, and FIG. 29, respectively.

Figure 1:
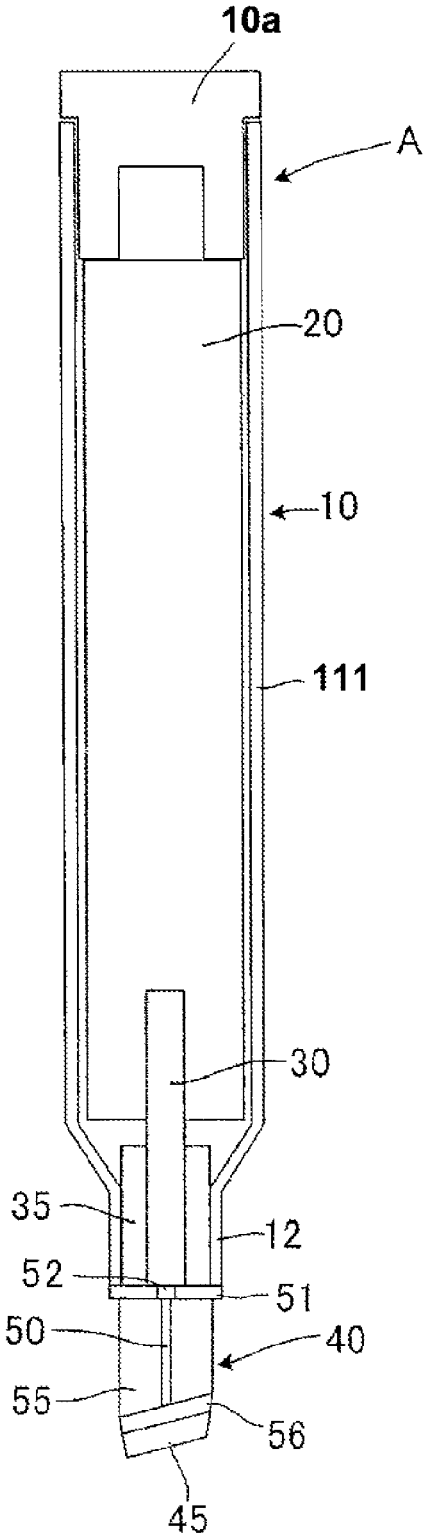
FIG. 1 is a vertical cross section showing one example of the embodiment of the present invention.
Figure 2A:
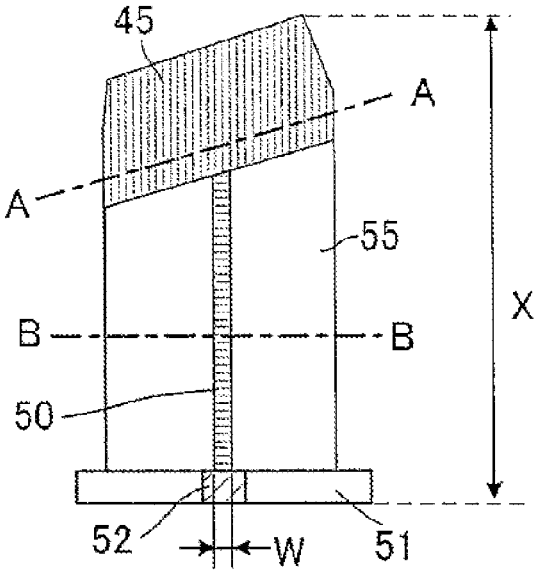
FIG. 2A is a vertical cross section showing one example of a tip used for the writing instrument of the present invention.
Figure 2B:
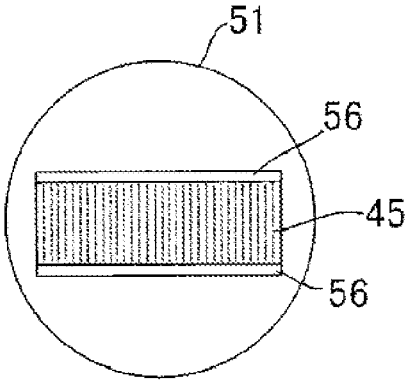
FIG. 2B is an A-A line cross section of FIG. 2A.
Figure 2C:
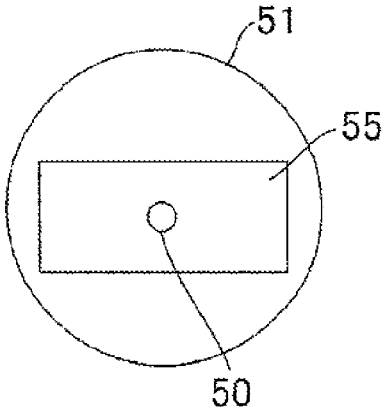
FIG. 2C is a B-B line cross section of FIG. 2A.

FIG. 1 is a vertical cross section showing one example of the embodiment of the writing instrument of the present invention, and FIG. 2 is a drawing showing a tip; FIG. 2A is a vertical cross section; FIG. 2B is an A-A line cross section of FIG. 2A; and FIG. 2C is a B-B line cross section of FIG. 2A.

The writing instrument A of the present embodiment is a writing instrument of a marking pen type, and it is equipped, as shown in FIG. 1, with a barrel 10 which is a writing instrument main body, a liquid occulusion body 20, a relay porous member 30, a tip 40 and a plug 60.

The barrel 10 is formed by, for example, a thermoplastic resin, a thermosetting resin, glass and the like, and the barrel 10 comprises a main body part 11 accepting the liquid occulusion body 20 impregnated with an ink for writing and a front holder 12 for fixing the tip 40.

The liquid occulusion body 20 is impregnated with an ink for writing, such as an aqueous ink and an oil-based ink. When the writing instrument is applied to an applicator, the ink is replaced with an appropriate cosmetic liquid such as an aqueous cosmetic an oil-based cosmetic, and an emulsified cosmetic thereof, having a viscosity of 1 to 15 mPa·s. The liquid occulusion body 20 comprises, for example, fiber bundles comprising one kind of or combination of two or more kinds of natural fibers, animal hair fibers, polyacetal base resins, acryl base resins, polyester base resins, polyamide base resins, polyurethane base resins, polyolefin base resins, polyvinyl base resins, polycarbonate base resins, polyether base resins, polyphenylene base resins and the like, materials obtained by processing fiber bundles such as felts and porous materials such as sponges, resin particles, and sintered matters. The above liquid occulusion body 20 is accepted in the main body part 11 of the barrel 10.

A rear end side opening part of the barrel 10 described above is sealed by the plug 60 formed by the same material as that of the barrel 10 or another synthetic resin-made material.

An ink composition used shall not specifically be restricted, and in an underline pen and the like, fluorescent pigments, for example, Basic Violet 11, Basic Yellow 40 and the like can be contained in an ink. Also, cosmetic liquid used shall not specifically be restricted, for example, such as an aqueous cosmetic, an oil-based cosmetic, and including an emulsified cosmetic thereof, having a viscosity of 1 to 15 mPa·s, preferably 1 to 10 mPa·s to obtain an efficient flow amount. Within the range of 1 to 15 mPa·s for the viscosity of the liquid, the applicator can supply sufficiently the cosmetic liquid for applying without a thrusting mechanism arranged in the rear of the barrel body.

The relay porous member 30 is a relay feed for feeding an ink in the liquid occulusion body 20 to a liquid guiding part 50 provided in a holding member 55 described later, and it comprises, as is the case with the liquid occulusion body 20, feeds having continuous pores (passages), such as fiber bundles, fiber bundle feeds obtained by processing fiber bundles including felts and the like, hard sponges, resin particle porous bodies comprising resin particle sintered bodies and the like, and sliver feeds. It shall not specifically be restricted in a form thereof, a structure thereof and the like as long as an ink impregnated in the liquid occulusion body 20 can be fed to the liquid guiding part 50 provided in the holding member 55 via the relay porous member 30. A cross-sectional form of the above relay porous member 30 includes, for example, forms of a circle, an ellipse, a square, a rectangle, a trapezoid, a parallelogram, a lozenge, a semicircle and a semilunar form, and in the present embodiment, the cross-sectional form is circular. The relay porous member 30 in the present embodiment takes, as shown in FIG. 1, a structure in which the relay porous member 30 is held by a supporting member 35 interfit in the front holder 12.

The tip 40 is equipped, as shown in FIG. 1 and FIG. 2, with a porous member (pen feed) 45 as a writing part and the holding member 55 holding the above porous member 45 and having the liquid guiding part 50 for feeding an ink to the writing part.

The porous member 45 as the writing part in the present embodiment is adhered in a front part of the holding member 55, and the porous member comprises, for example, parallel fiber bundles comprising one kind of or combination of two or more kinds of natural fibers, animal hair fibers, polyacetal base resins, polyethylene base resins, acryl base resins, polyester base resins, polyamide base resins, polyurethane base resins, polyolefin base resins, polyvinyl base resins, polycarbonate base resins, polyether base resins, polyphenylene base resins and the like, fiber feeds obtained by processing fiber bundles such as felts or subjecting these fiber bundles to resin processing and porous matters (sintered feeds) obtained by sintering various plastic powders and the like. When the writing instrument is also used as an applicator, the above the porous member 45 as the writing part functions as an applying part for liquids of a cosmetic composition.

A form of the porous member 45 as a writing part includes, for example, forms such as a chisel form, a shell form, a cylinder, an elliptical cylinder, a cube, and a cuboid in terms of an appearance form, and the form includes such as a trapezoid, a parallelogram, a lozenge, a semicircle, and a semilunar form in terms of a cross-sectional form. In the present embodiment, the form is a chisel form. The chisel form is a form in which an inclined plane is formed at a tip toward a central line of a pen holder and in which the inclined plane is flat.

Also, the porous member 45 as the writing part or the applying part inclines preferably at an angle of 40 to 90° toward a major axis direction of a main body axis so that it is an inclination at which writing is easy, and the angle is an inclination of 75° in the present embodiment.

A form, an inclination and the like of the porous member 45 as the writing part are suitably set in keeping with usability in writing and the like. Also, the porous member 45 as the writing part has a large drawn line width, and the writing part has a drawn line width of preferably 2 mm or more, more preferably 3 mm or more, which are also proper dimensions when the writing instrument is used as the applicator.

The holding member 55 of the present embodiment is constituted from materials having visibility, for example, materials such as PP, PE, PET, PEN, nylon (including amorphous nylons and the like in addition to conventional nylons such as 6 nylon and 12 nylon), acryl, polymethylpentene, polystyrene, and ABS, and it is constituted preferably from materials having a visible light transmittance of 50% or more. When materials having a visible light transmittance of less than 50% are used, characters written toward a writing direction cannot effectively be visually recognized in a certain case, and therefore such materials are not preferred. Materials having a visible light transmittance of 50% or more are preferred in order to make it possible to exert further better visual recognition function, and materials having a visible light transmittance of 80% or more make it possible to visually recognize characters further better. The visible light transmittance can be determined by measuring a reflectance by means of a multi-illuminant colorimeter. When the writing instrument is used as the applicator, visibility of the holding member 55 makes it possible to see toward an applying direction.

The above holding member 55 can be constituted from one kind of the respective materials described above, or two or more kinds of the materials in terms of further enhancing the durability and the visibility. When the above holding member 55 is constituted from two or more kinds of the materials, at least one of them is preferably the material having a visible light transmittance of 50% or more, and the holding member 55 can be molded by various molding methods such as injection molding and blow molding.

At least one liquid guiding part 50 for feeding an ink to the writing part is provided in an inside of the holding member 55 described above, and in the present embodiment, one liquid guiding part 50 is provided, as shown in FIGS. 2A and 2C, in the center of a longitudinal direction in the form of passing through the holding member in terms of maximizing an area ratio of a visible part and feeding efficiently the ink to the porous member as the writing part.

A form, a structure, a size and the number of the above liquid guiding part 50 can suitably be selected as long as set is a structure in which an ink impregnated in the liquid occulusion body 20 accepted in the writing instrument main body can be fed directly to the liquid guiding part via the relay porous member 30 described above.

From the viewpoint of maximizing the effects of the present invention, a length W of the liquid guiding part 50 in a cross section width direction is preferably less than 40%, more preferably 1 to 30% of a major axis length X of the tip. Also, a cross-sectional area of the liquid guiding part 50 is preferably less than a cross-sectional area of the writing part at a holding member side or less than a cross-sectional area of the relay porous member 30 at a holding member side.

In particular, from the viewpoint of securing a sufficiently high writing flow amount without damaging visibility of the holding part, the liquid guiding part 50 has a tubular form in which a length in a lateral direction of the liquid guiding part is preferably 3 mm or less, more preferably 0.1 to 2.5 mm and in which a diameter is 0.1 to 3.0 mm, preferably 0.2 to 2.5 mm and more preferably 0.2 to 2.0 mm.

Also, the sum of a cross-sectional area of the liquid guiding part 50 in the holding member 55 is 0.01 to 7 $mm^2$, preferably 0.03 to 5 $mm^2$ and more preferably 0.03 to 4 $mm^2$.

Further, a taper is preferably formed toward a writing part 45 side in the liquid guiding part 50, and only one taper, though may be a plurality of two or more tapers, is preferably provided in a direction of 0 to 30° toward a major axis direction of a main body axis.

Also, a form of the liquid guiding part 50 is preferably straight to a major axis direction, and the liquid guiding part 50 can be as well, as described later, a form which is liable to be visually recognized, such as a V form, an X form, a Y form, a spiral form, an inverted V form and an inverted Y form.

In the present embodiment, from the viewpoints of protecting the porous member as the writing part and securing a sealing property thereof, a flange 51 is integrally formed at a relay porous member 30 side of the holding member 55 by the same material as that of the holding member, and an aperture part 52 which is larger than the liquid guiding part 50 is formed in a concentric circle form at a tip of the liquid guiding part 50.

A method for forming the liquid guiding part 50 having the structure described above includes, for example, a method in which a resin is inserted into a die equipped with a bar-like member and the like for forming a liquid guiding part and molded by the respective resin molding methods such as injection molding and blow molding and in which the molded matter is then removed from the die to form the liquid guiding part 50 in the holding member 55, a method in which the holding member 55 is molded and in which the liquid guiding part 50 is then formed by drilling and laser processing and the like and a method in which the holding member 55 is divided into two members, in which grooves for forming a liquid guiding part are formed in the respective members and in which they are then integrated by adhesion, fusion and the like to form the liquid guiding part 50 in the holding member 55. The liquid guiding part 50 can be formed by the same methods as described in the prior art documents.

In the present invention, the liquid guiding part 50 provided in an inside of the holding member 55 described above has preferably a visible light transmittance of less than 50% in a state in which an ink for writing described later is accepted therein, and it is preferable that the liquid guiding part 50 does not function as a visible part and does not make it possible to visually recognize a writing direction effectively. If an ink can be visually recognized in a state in which the ink is accepted in the liquid guiding part 50, the color components and the like of the ink are limited in use, and ink colors corresponding to the needs are not available, so that it is not preferred. In the above case, a pipe colored with almost the same color as that of the ink for writing may be inserted into the liquid guiding part 50 to make it possible to readily recognize the ink color.

Also, parts other than the liquid guiding part 50 in the holding member 55 are faces for forming a visible part, and they are preferably almost parallel faces in order to visually recognize a writing direction effectively. The writing direction can be enlarged and visually recognized as well by providing the visible part with a lens face.

In the present invention, the porous member 45 as the writing instrument described above is adhered to the holding member 55 having the liquid guiding part 50 by allowing the resin for forming the holding member to be sintered into pores of the porous member 45 from the holding member 55 at a part at which the porous member 45 is brought into contact with the holding member 55 to form a holding member resin layer from the viewpoint of firmly adhering the porous member 45 in a state of providing it with a sealing performance, whereby the porous member 45 and the holding member 55 are preferably are adhered to each other.

The materials for forming the porous member 45 and the holding member 55 are selected preferably from resins having different solubilities in a solvent. For example, in a case in which the porous member 45 is a polyethylene-made sintered feed and in which the holding member is made of acryl, organic solvents such as alcohols, esters (butyl acetate), ethers, ketones (acetone), glycol ethers, alicyclic hydrocarbons, aliphatic hydrocarbons, chloro-substituted aliphatic hydrocarbons (dichloromethane), aromatic hydrocarbons, and chloro-substituted aromatic hydrocarbons are used as the solvent since a difference in a solubility parameter (SP value) between the porous member resin and the holding member resin can be set to 0.5 or more, whereby the porous member 45 as the writing instrument described above and the holding member 55 having the liquid guiding part 50 can be adhered to each other.

A holding member resin layer (hereinafter the holding member resin layer in an interface is referred to as an adhesion face) is formed preferably in an end face of the liquid guiding part 50 at a writing part porous member 45 side in an interface between the porous member 45 and the holding member 55, and the above adhesion face is preferably formed toward a whole direction of the end face in a length of 0.5 mm or more, more preferably 0.8 to 3 mm.

The above adhesion face can be formed in any of a plane, a curved surface and a bent part, and the adhesion face is preferably formed in an end face of the liquid guiding part 50 at a writing part porous member 45 side in a length of 0.5 mm or more, more preferably 0.8 to 3 mm over a whole periphery of the above end face.

Also, the holding member resin layer on the adhesion face is preferably formed in a depth of 1 to 1000 μm, more preferably 10 to 800 μm toward an inside of the porous member 45, and a surface of a local peak in a contact part of the holding member 55 brought into contact with the porous member 45 in the writing part is preferably turned into a satin finished surface state by surface texturing and the like.

FIG. 3 and FIG. 4 show an embodiment of an adhesion structure between the porous member 45 as the writing part and the holding member 55 having the liquid guiding part 50.

Figure 3A:
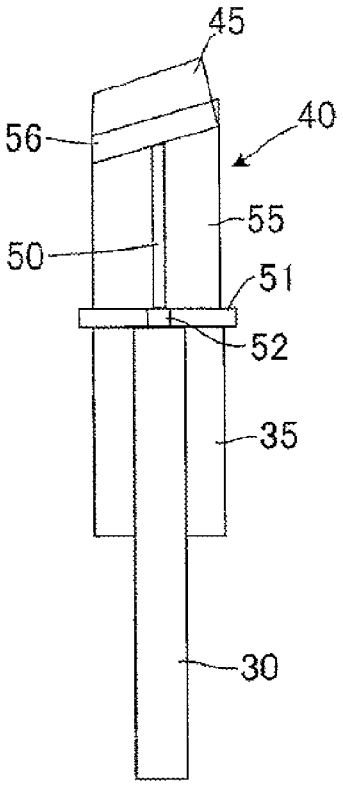
FIG. 3A is a front view showing a state in which a relay porous member, a porous member as a writing part, a holding member having a liquid guiding part and the like are set.
Figure 3B:
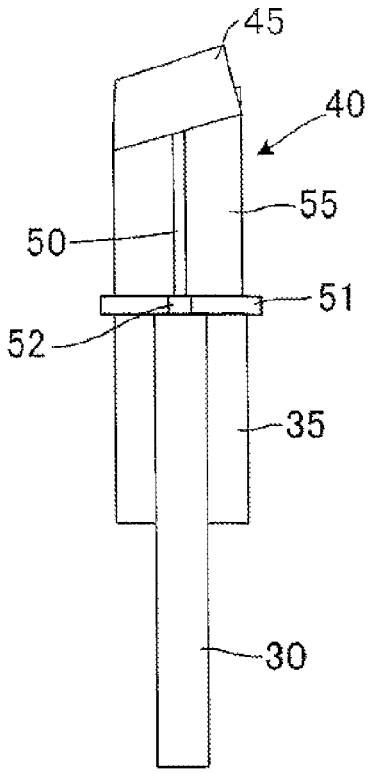
FIG. 3B is a vertical cross section of FIG. 3A.
Figure 3C:
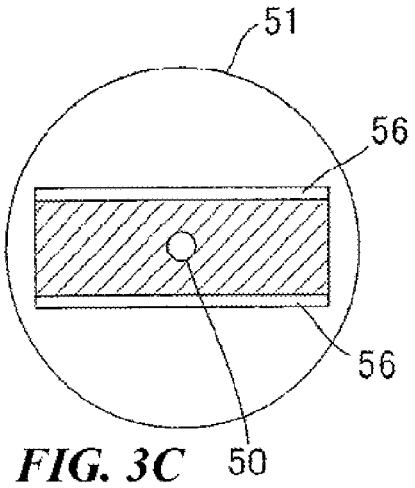
FIG. 3C and FIG. 3D are a plan view and a perspective drawing of the holding member, respectively.
Figure 3D:
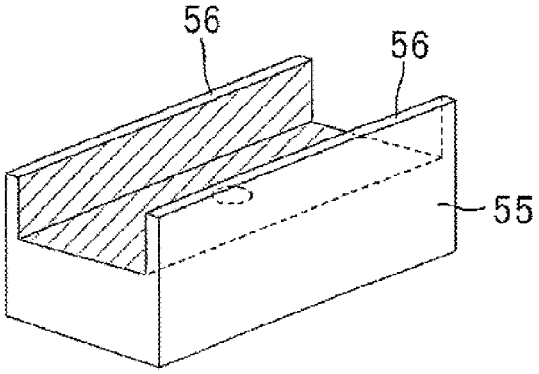
Figure 4A:
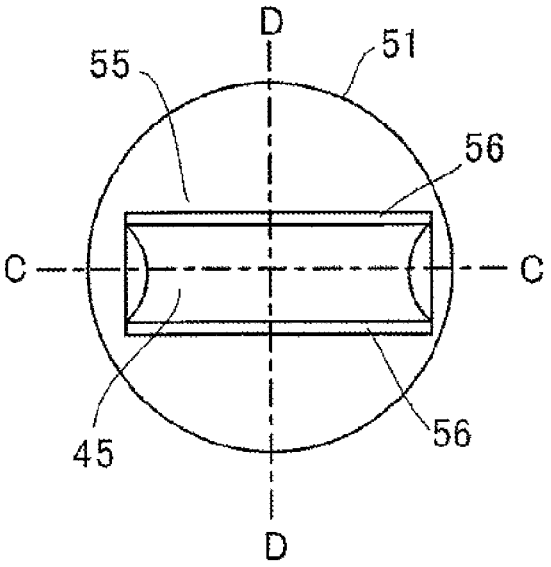
FIG. 4A is a plan view showing a state in which a porous member as a writing part and a holding member having a liquid guiding part are set.
Figure 4B:
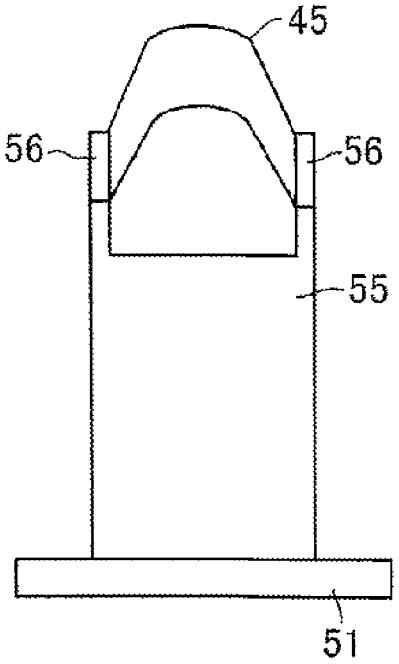
FIG. 4B is a side view thereof.
Figure 4C:
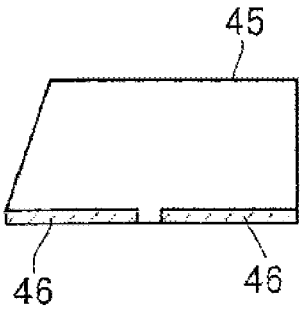
FIGS. 4C and 4D are a front view and a side view, respectively, showing a holding member resin layer in an interface between a porous member and a holding member.
Figure 4D:
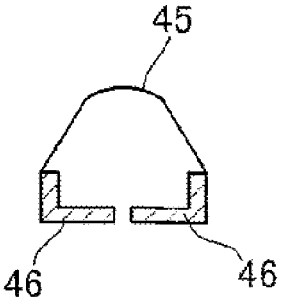

In FIG. 3, FIGS. 3A and 3B are a front view and a vertical cross section showing a state in which the relay porous member 30, the supporting member 35, the porous member 45 as the writing part and the holding member 55 having the liquid guiding part 50 are set, and FIGS. 3C and 3D are a plan view and a perspective drawing of the holding member 55. In FIG. 4, FIG. 4A is a plan view showing a state in which the porous member 45 as the writing part and the holding member 55 having the liquid guiding part 50 are set; FIG. 4B is a side view thereof; and FIGS. 4C and 4D are a front view and a side view showing a holding member resin layer 46 in an interface between the porous member 45 and the holding member 55.

In the above embodiment, rib members 56 are provided, as shown in FIG. 3D, on two or more side faces of the porous member 45 in the writing part on an upper part of the holding member 55 from the viewpoint of firmly adhering the porous member 45 as the writing part and the holding member 55 having the liquid guiding part 50, and in the present embodiment, two rib members are provided.

Also, two faces in insides of side faces of the rib members 56 and a base part excluding an aperture part of the liquid guiding part 50 are, as shown in FIG. 3D, adhesion faces between the porous member 45 as the writing part and the holding member 55 having the liquid guiding part 50, and a surface of a local peak at a contact part of the holding member 55 brought into contact with the porous member 45 in the writing part is preferably turned into a satin finished surface state by surface texturing and the like.

In the above embodiment, the porous member 45 and the holding member 55 can be adhered by double molding.

In the present embodiment thus constituted, the porous member 45 as the writing instrument described above is adhered to the holding member 55 having the liquid guiding part 50 by allowing the resin for forming the holding member to be sintered into pores of the porous member 45 from the holding member 55 at a part at which the porous member 45 is brought into contact with the holding member 55 to form a holding member resin layer 46 on the base part, whereby the porous member 45 as the writing part and the holding member 55 having the liquid guiding part 50 can surely be adhered, and a writing instrument which can secure a sufficiently high writing flow amount to end of writing and which is excellent in durability is obtained.

Also, in the present invention, the relay porous member 30 can be adhered to the holding member 55, as is the case with the embodiment described above, by forming a holding member resin layer.

Figure 5A:
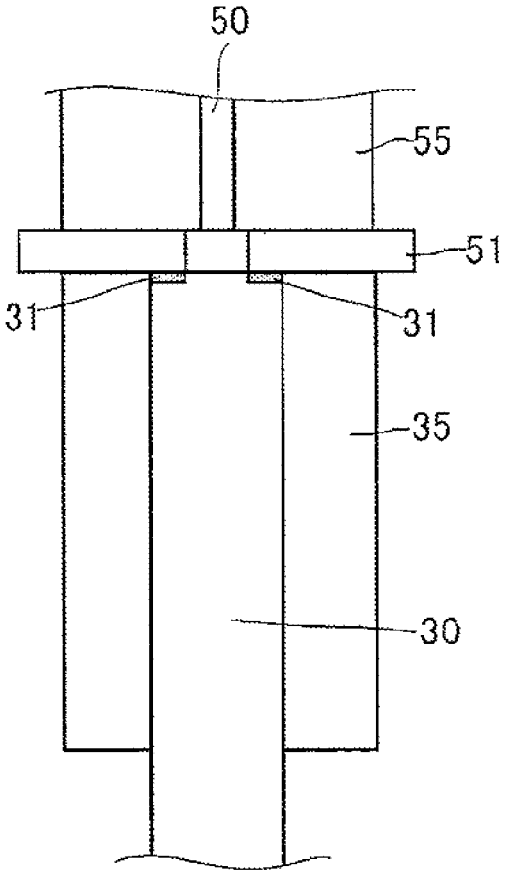
FIG. 5A is a vertical cross section showing one example of an expanded state in which a holding member having a liquid guiding part and a relay porous member are set.

To be specific as shown in FIG. 5A, a relay porous member 30 side adhesion face is formed in any of a plane, a curved surface and a bent part, and a holding member resin layer (hereinafter referred to as "a relay porous member side adhesion face") is formed in an end face at a relay porous member 30 side of the liquid guiding part 50 in a thickness of 0.5 mm or more over a whole periphery of the relay porous member 30 in an interface between the holding member 55 and the relay porous member 30 inserted into a supporting member 35 of the above holding member 55. A circumferential holding member resin layer 31 on the relay porous member 30 side adhesion face is formed in a depth of 1 to 1000 μm toward a porous member inside, and a surface of a local peak in a contact part of the holding member 55 brought into contact with the relay porous member 30 is turned into a satin finished surface state by surface texturing and the like.

Figure 5B:
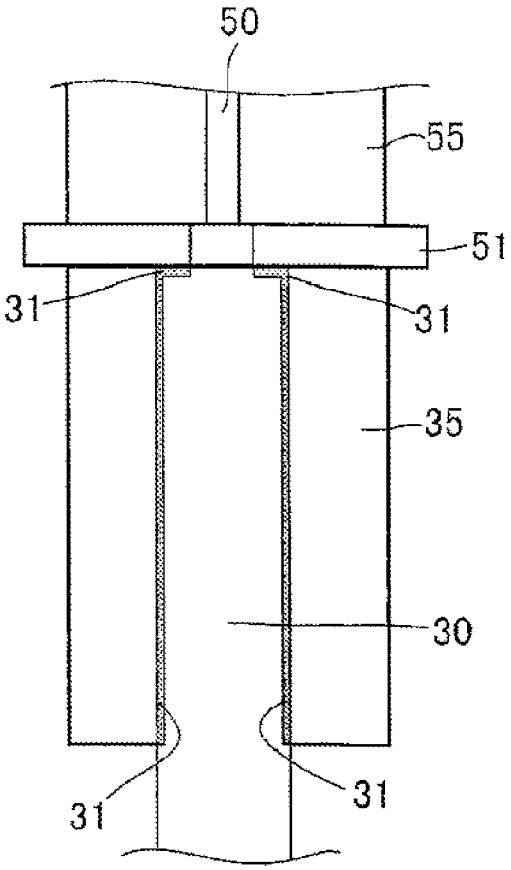
FIG. 5B is a vertical cross section showing another example of FIG. 5A.

In the present embodiment thus constituted, the relay porous member 30 is adhered to the holding member 55 having the liquid guiding part 50 by allowing the resin for forming the holding member to be sintered into pores of the relay porous member 30 from the holding member 55 at a part at which the relay porous member 30 is brought into contact with the holding member 55 to form a holding member resin layer 31, whereby the relay porous member 30 and the holding member 55 having the liquid guiding part 50 can surely be adhered; a sufficiently high writing flow amount can be fed to the liquid guiding part 50; and the writing instrument is excellent in durability. Also, the holding member resin layer 31 may be formed, as shown in FIG. 5B, in the whole of a part into which the relay porous member 30 is pressed and in which the supporting member 35 is brought into contact with the relay porous member 30.

In the writing instruments shown in FIGS. 1 to 5 of the present embodiment, the tip 40 is equipped, as described above, with the porous member 45 as the writing part and the holding member 55 holding the above porous member 45 and having at least one liquid guiding part 50 for feeding an ink to the writing part, and it has the relay porous member 30 for feeding the ink contained in the writing instrument main body 10 to the liquid guiding part 50 provided in the holding member 55. The holding member 55 described above is constituted by a material having visibility, and therefore in the above holding member 55, a whole face (whole part) other than the liquid guiding part 50 is a visible part in which a writing direction can be visually recognized. An area ratio of the visible part on a front face can be first controlled to 40% or more of the tip protruding from a tip part of the writing instrument main body 10 by employing the above structure, and an area ratio of the visible part on a side face of the holding member 55 in the tip is preferably controlled as well to 40% or more. Further, an area ratio of the visible part can be controlled to 50% or more by forming the liquid guiding part 50 in a central part of a longitudinal direction of the holding member 55 and setting a length, a diameter and a cross-sectional area of the liquid guiding part 50 in a lateral direction to the preferred ranges described above, and provided is a writing instrument which can be endowed with a sufficiently high visibility making it possible to read characters written toward a writing direction more surely than ever and which can be used to end of writing. In particular, an ink can efficiently be fed evenly to the porous member 45 as the writing part by forming the liquid guiding part 50 in a central part of a longitudinal direction of the holding member 55, and therefore a writing instrument which can be used to end of writing is provided.

Also, the form in which a writing direction is liable to be determined and in which the writing instrument is very liable to write is obtained by forming the liquid guiding part 50 in a central part of a longitudinal direction of the holding member 55.

Further, providing the rib members 56 on an upper part of the holding member 55 makes it possible to draw straight lines without staining a ruler when drawing them with the ruler.

Further, an ink can efficiently be fed to the porous member 45 as the writing part by employing a mechanism in which a liquid is fed directly to the liquid guiding part 50. When a porous member is used as the liquid guiding part 50, a suitable ink flow amount is not obtained in a certain case.

In the embodiment described above, the liquid guiding part 50 having a form in which it is formed linearly toward a major axis direction is described in detail, and a form of the liquid guiding part 50 at the tip 40 can be turned into a form which is liable to be visually recognized by employing the respective forms shown in FIG. 6 and FIG. 7. In FIG. 6 and FIG. 7, the same numerals shall be given to the same constitutions as in the embodiments described above to omit the explanations thereof.

Figure 6A:
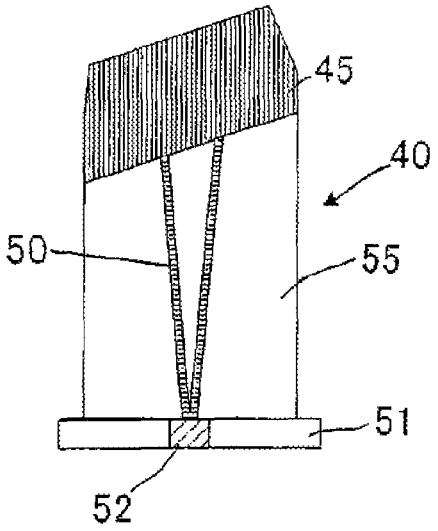
FIGS. 6A to 6D are front views showing the respective forms of a liquid guiding part of a tip toward a major axis direction excluding a straight line form.
Figure 6B:
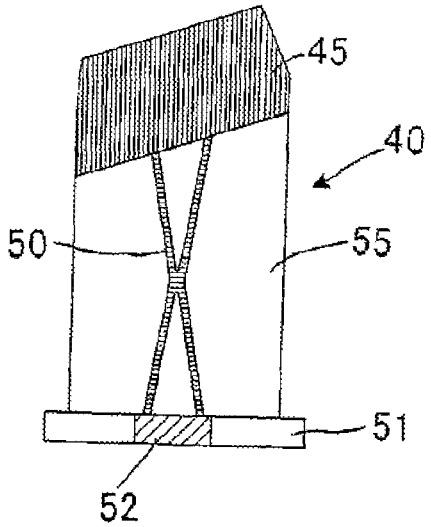
Figure 6C:
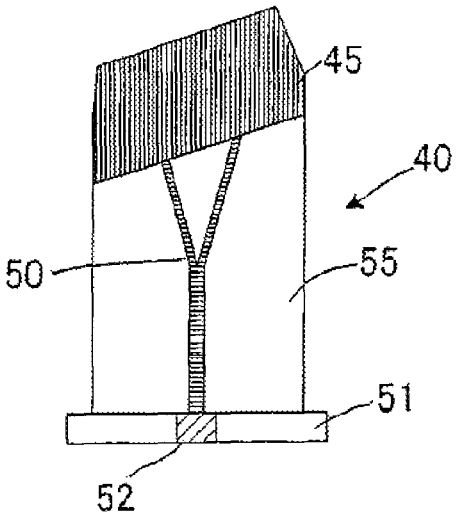
Figure 6D:
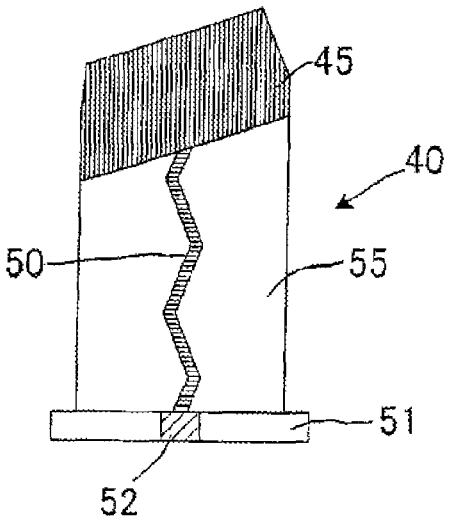
Figure 7A:
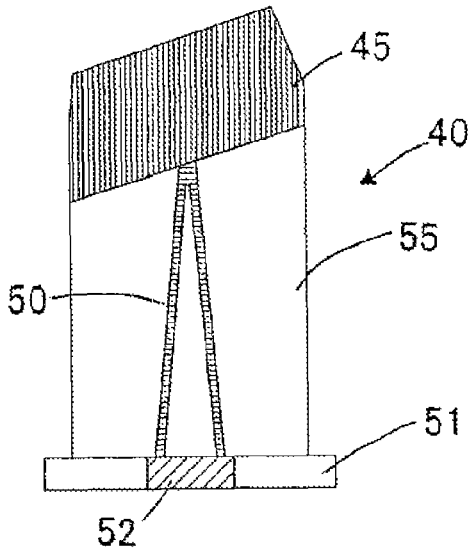
FIGS. 7A and 7B are continuous from FIGS. 6A to 6D and are front views showing the respective forms of a liquid guiding part of a tip toward a major axis direction excluding a straight line form.
Figure 7B:
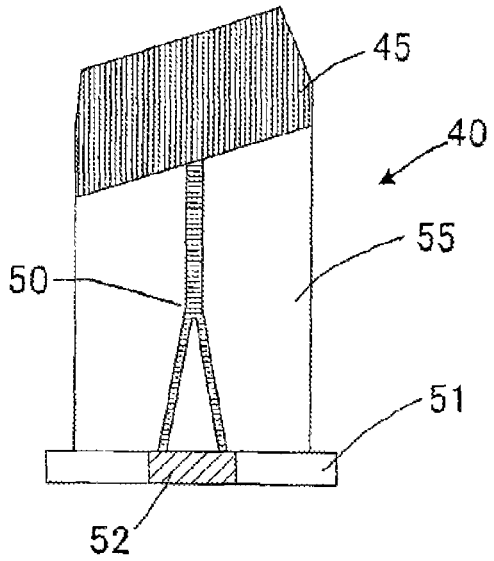

FIG. 6A shows a V form used as a form of the liquid guiding part 50; FIG. 6B shows an X form; FIG. 6C shows a Y form; FIG. 6D shows a spiral form; FIG. 7A shows an inverted V form; and FIG. 7B shows an inverted Y form.

Also, in the embodiment described above, two rib members 56 are provided, and three rib members may be provided. Further, they can be provided as well on a whole periphery (four directions) of the porous member.

Figure 8A:
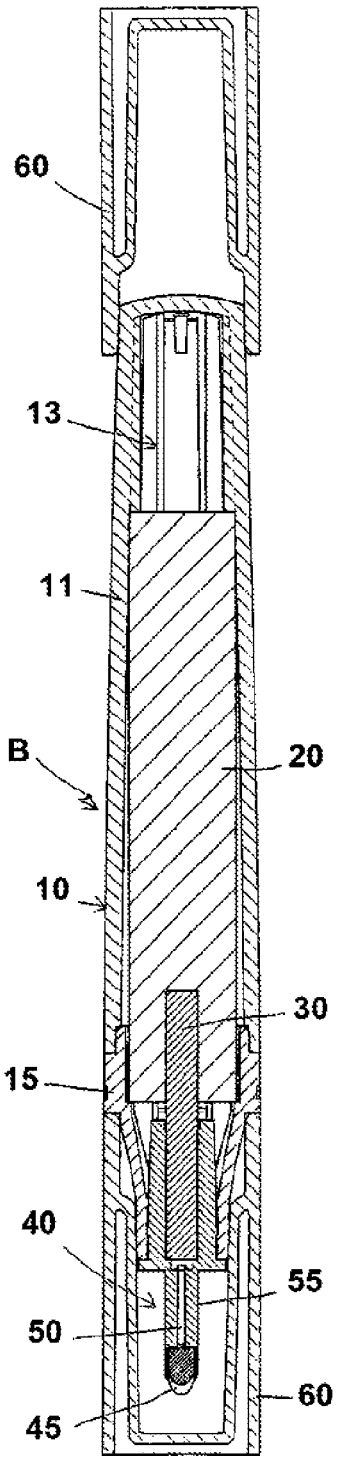
FIGS. 8A and 8B are drawings of a writing instrument showing another example of the embodiment of the present invention.
Figure 8B:
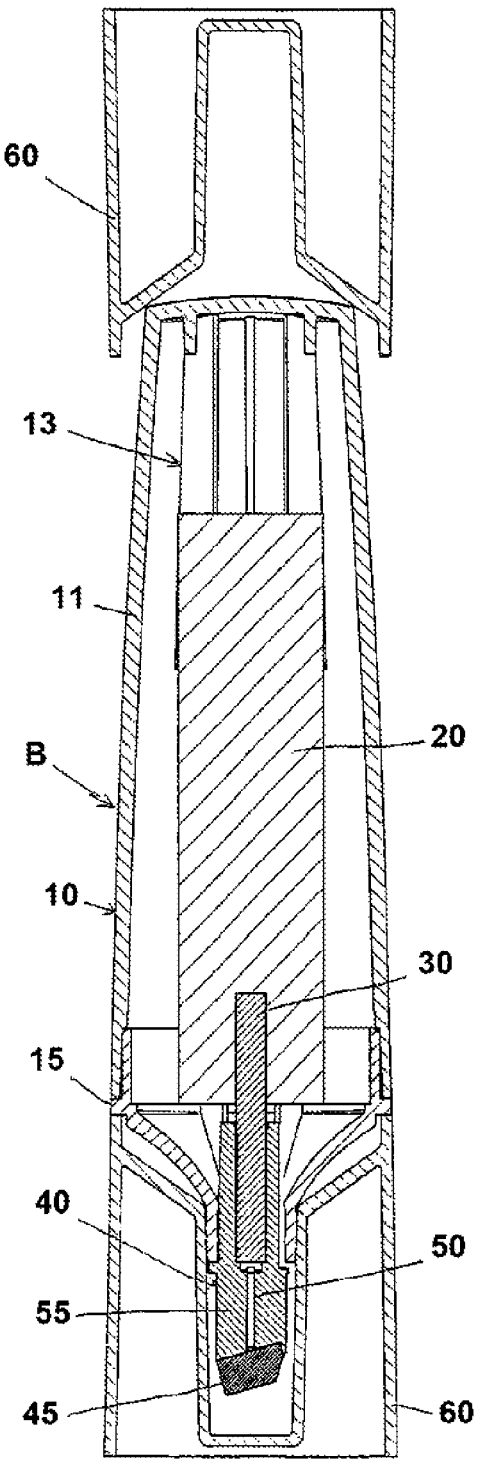
Figure 9A:
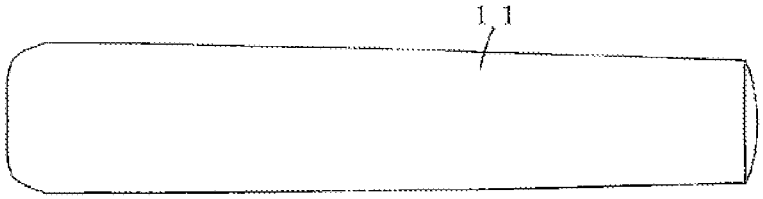
FIGS. 9A to 9E are drawings showing one example of a rear holder constituting a holder of the writing instrument shown in FIGS. 8A and 8B.
Figure 9B:
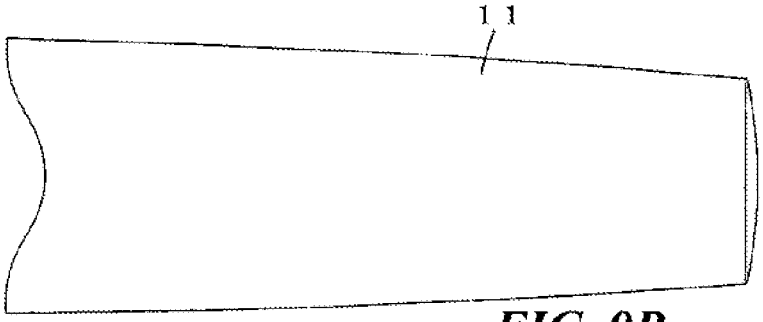
Figure 9C:
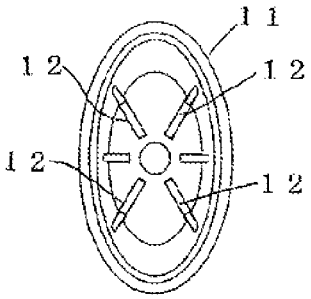
Figure 9D:
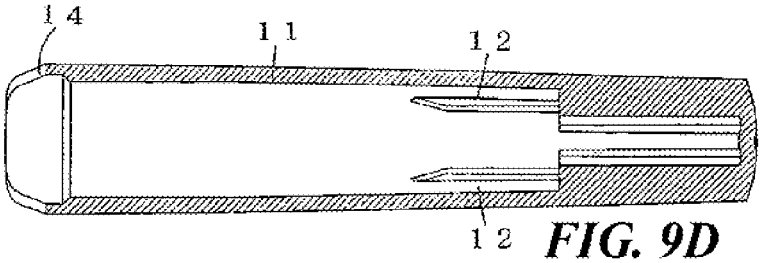
Figure 9E:
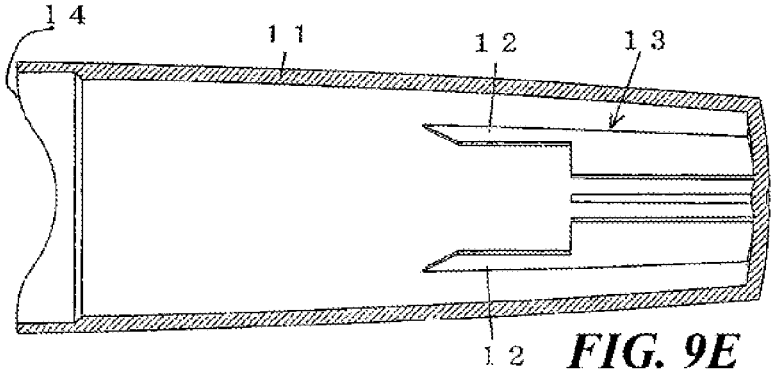
Figure 10A:
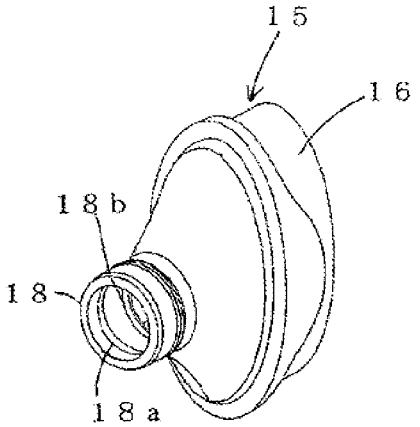
FIGS. 10A to 10E are drawings showing one example of a front holder of the writing instrument shown in FIGS. 8A and 8B.
Figure 10B:
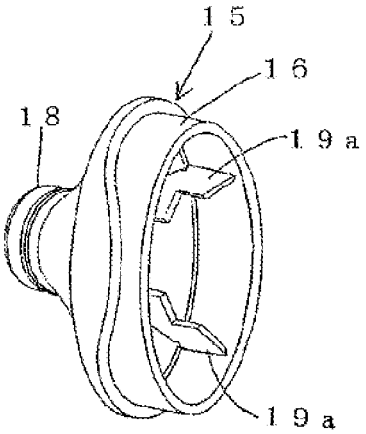
Figure 10C:
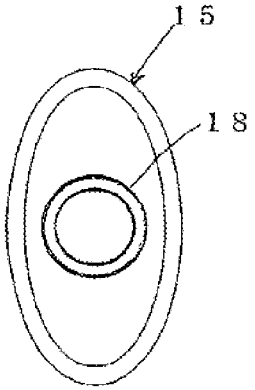
Figure 10D:
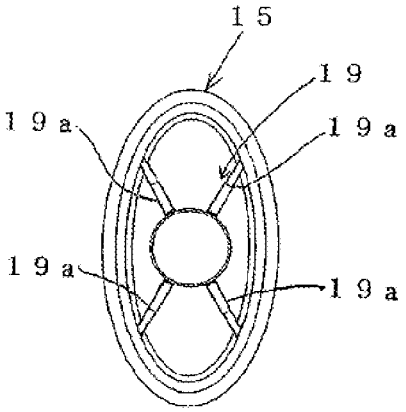
Figure 10E:
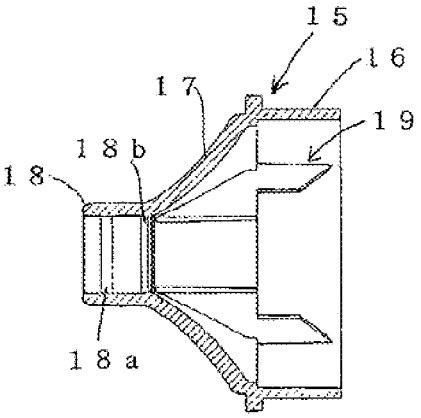
Figure 11D:
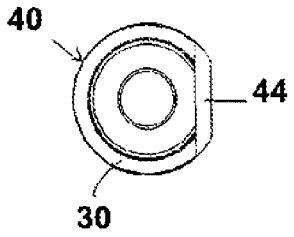
FIGS. 11A to 11D are drawings showing one example of a tip used for the writing instrument shown in FIGS. 8A and 8B.
Figure 11A:
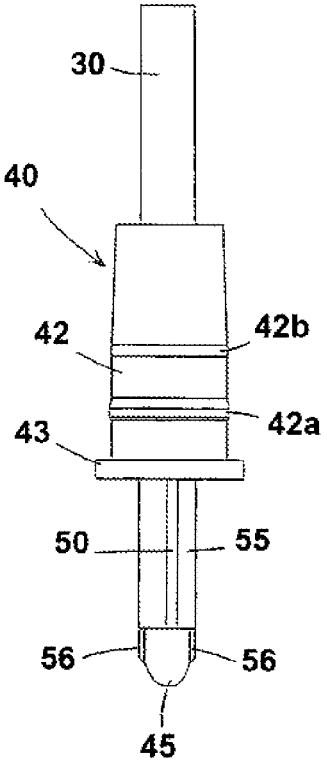
Figure 11B:
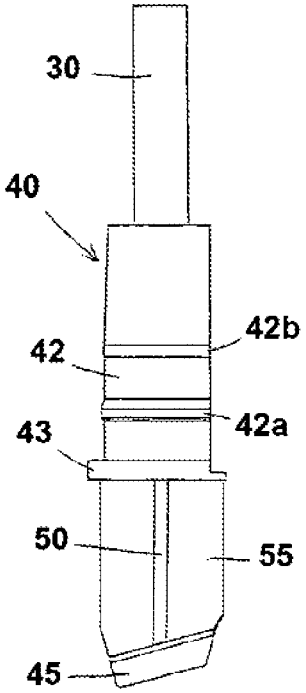
Figure 11E:
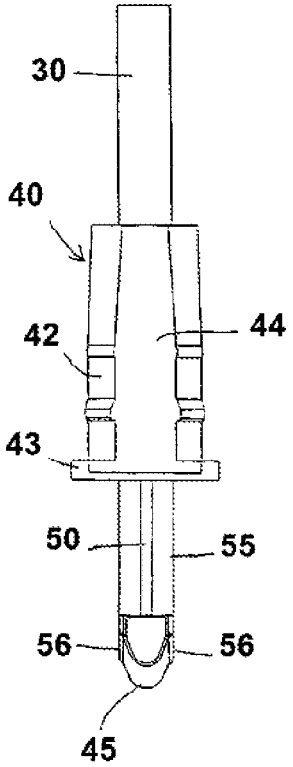
FIG. 11E is a base view.
Figure 11C:
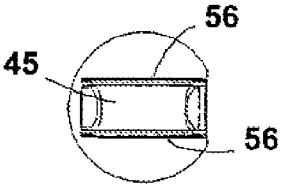
Figure 12A:
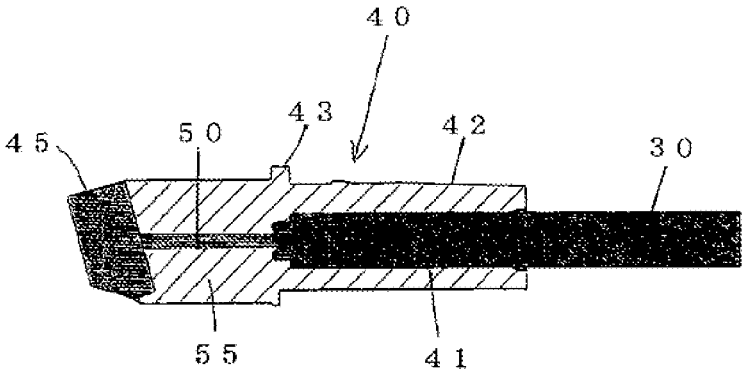
FIG. 12A is a central lateral cross section of a tip.
Figure 12B:
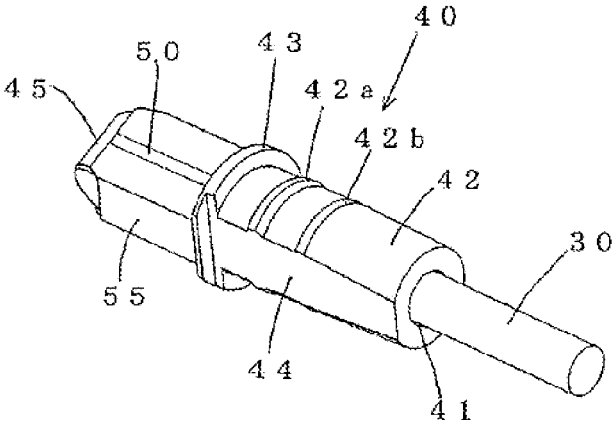
FIG. 12B is a perspective drawing of a tip observed from a base side.
Figure 20:
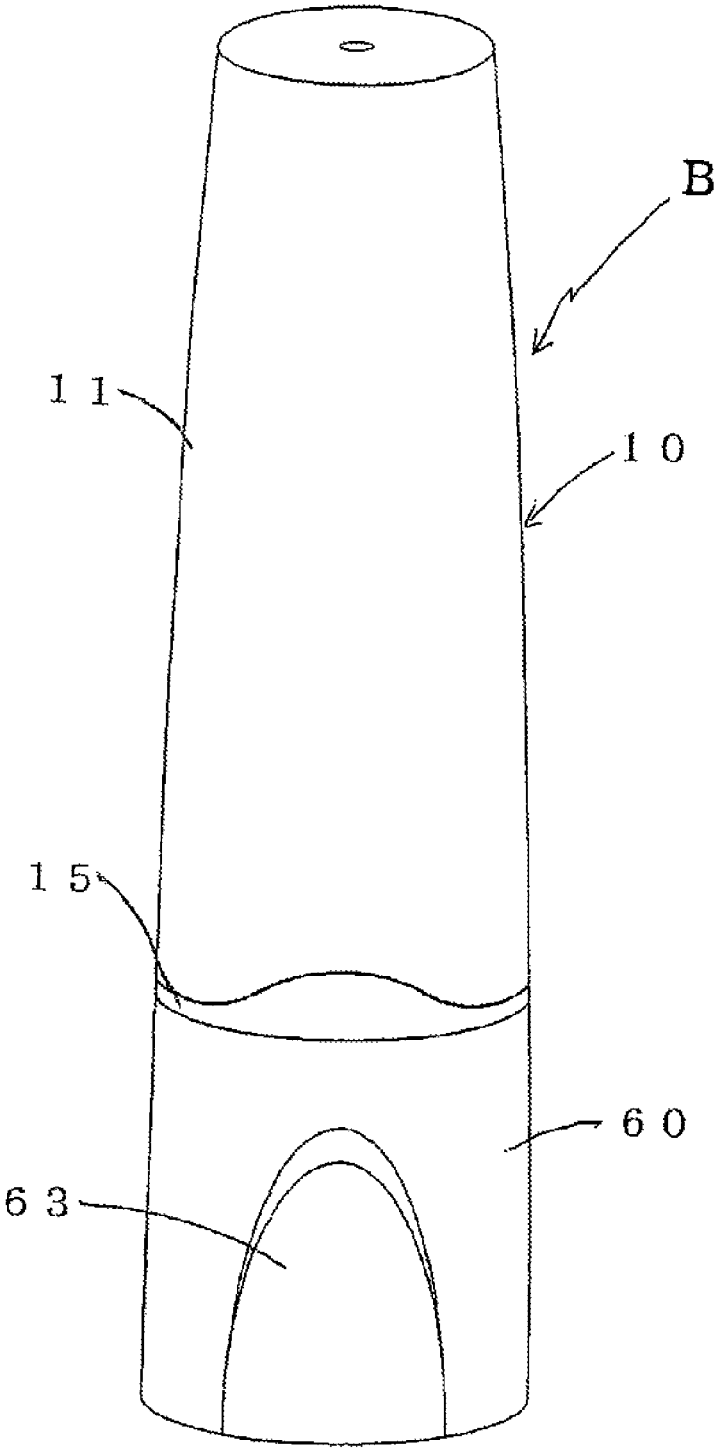
FIG. 20 is a drawing showing one example of a state in which a cap member is put on the writing instrument shown in FIGS. 8A and 8B.
Figure 21A:
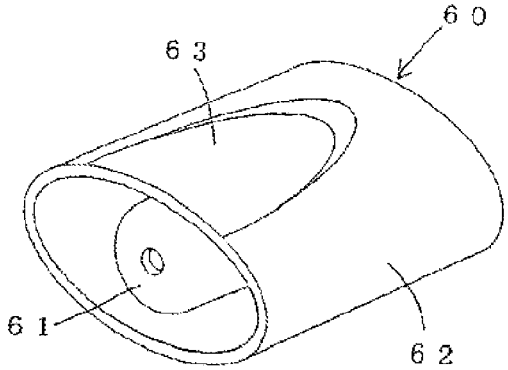
FIGS. 21A to 21D are drawings showing one example of a cap member of the writing instrument shown in FIGS. 8A and 8B.
Figure 21B:
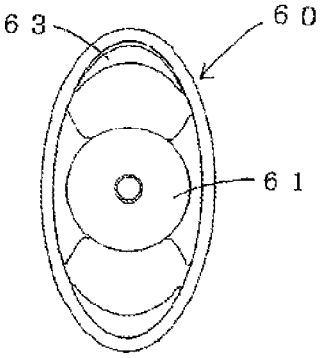
Figure 21C:
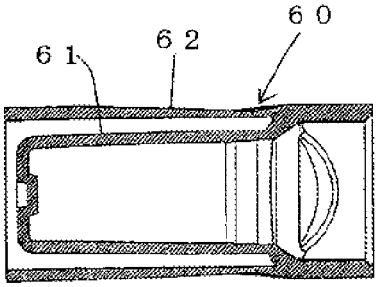
Figure 21D:
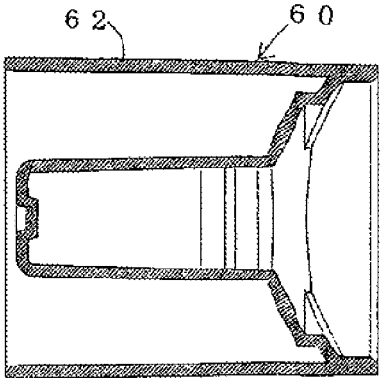

FIG. 8 to FIG. 21 are the respective drawings showing different examples of the embodiments of the writing instruments in the present invention, wherein FIGS. 8A and 8B are a central vertical cross section and a central lateral cross section in the whole of the writing instrument. FIG. 9 to FIG. 16 are the respective drawings showing a rear holder, a front holder, a tip and the respective parts of the tip which constitute the writing instruments. FIG. 17 and FIG. 18 are the respective drawings showing the writing instrument of a state in which a cap member is removed, and FIG. 19 and FIG. 20 are the respective drawings showing the writing instrument of a state in which a cap member is attached. FIG. 21 is a drawing of the cap member. In FIGS. 8A and 8B, shown are two embodiments of a state in which a cap member is attached to an ordinary front holder side and a state in which it is removed therefrom and attached to a rear barrel side of the writing instrument main body.

The same numerals shall be given to the respective parts (a barrel, a liquid occulusion body, a relay porous member and tip parts) having the same structures, characteristics and qualities as those of the writing instrument A of the embodiment described above to omit or simplify the explanations thereof.

The writing instrument B of the above embodiment is a writing instrument of a marking pen type, and the writing instrument B is equipped, as shown in FIG. 8, with a barrel 10, a liquid occulusion body 20, a relay porous member 30, a tip 40 and a cap member 60 which constitute a writing instrument main body.

The barrel 10 is formed by, for example, a thermoplastic resin, a thermosetting resin, glass and the like, and the barrel 10 has, as shown in FIG. 8 to FIG. 10, a closed-bottom cylindrical rear barrel 11 for accepting the liquid occulusion body 20 impregnated with an ink for a writing instrument and a front holder 15 for adhering the tip 40.

The rear barrel 11 is molded, for example, in a long closed-bottom elliptically cylindrical form by using a synthetic resin such as PP, and the rear barrel 11 functions as a main body (barrel) of the writing instrument. The above rear barrel 11 is provided, as shown in FIGS. 9A to 9E, with a holding member 13 comprising holding pieces 12, 12—for holding a rear end part of the liquid occulusion body 20 inside of a rear end, and the whole of the rear barrel and the front holder described later are molded in an opaque or transparent (and translucent) state. Any of them may be employed from the viewpoint of the appearance and the utility. Also, a structure in which the front holder 15 is adhered in an aperture part 14 of the rear barrel 11 by interfitting and the like is taken.

The front holder 15 has, as shown in FIGS. 10A to 10E, a circular interfitting part 16 interfitting with the aperture part 14 of the rear barrel 11 at a rear side and a shoulder part 17 and a cylindrical inserting part 18 fixing a main body part 41 of the tip 40 at a front side, and a holding member 19 comprising holding pieces 19*a*, 19*a*—for holding a front end part of the liquid occulusion body 20 is provided in the interfitting part 16 described above. Inserting projection parts 18*a*, 18*b* are provided on an inner circumference of the inserting part 18 described above. The front holder 15 of the above structure is molded, for example, by a synthetic resin comprising PP and the like.

The liquid occulusion body 20 is impregnated with an ink for writing, such as an aqueous ink and an oil-based ink. When the writing instrument is applied to an applicator, the ink is replaced with an appropriate cosmetic liquid such as an aqueous cosmetic, an oil-based cosmetic, and including an emulsified cosmetic thereof, having a viscosity of 1 to 15 mPa·s. The liquid occulusion body 20 comprises fiber bundles, materials obtained by processing fiber bundles such as felts and porous materials such as sponges, resin particles, and sintered matters which are the same as in the embodiment described above. The above liquid occulusion body 20 is accepted and held in the rear barrel 11 which is a main body of the barrel 10. Also, an ink composition used shall not specifically be restricted as is the case with the writing instrument A of the embodiment described above.

Also, the relay porous member 30 which is a feeder is a feed for relaying which supplies an ink in the liquid occulusion body 20 to a liquid guiding part 50 provided in a holding member 55 described later, and there has a structure in which the relay porous member 30 is penetrated into a concave part at a front side of the liquid occulusion body 20. The above relay porous member 30 is constituted in the same structure as in the writing instrument A of the embodiment described above.

The tip 40 is equipped, as shown in FIG. 11 to FIG. 16, with a porous member (pen feed) 45 as a writing part and a holding member 55 having a liquid guiding part 50 for feeding an ink to the writing part, and the holding member 55 is connected with a main body part 42 having a cylindrical part 41 holding a relay porous member at a rear side. A flange part 43 is provided in an outer circumference of the main body part 42, and an inserting holding part 41*a* for inserting and holding the relay porous member 30 is provided in an inlet of the cylindrical part 41.

Figure 13:
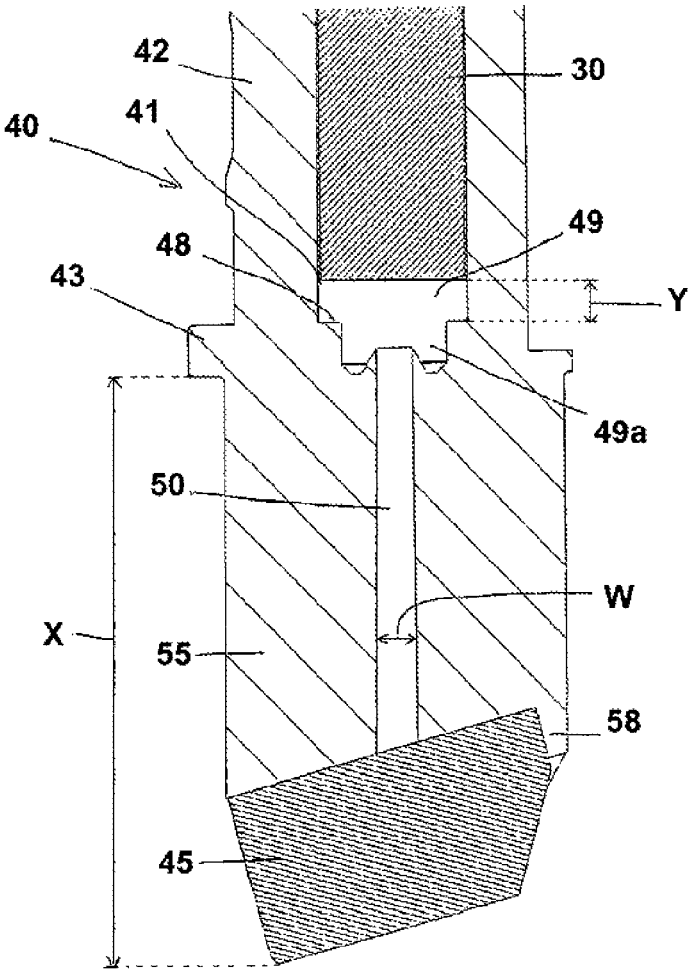
FIG. 13 is an enlarged view of a central lateral cross section of the tip shown in FIG. 12A and is a drawing for explaining a gap part.
Figure 14A:
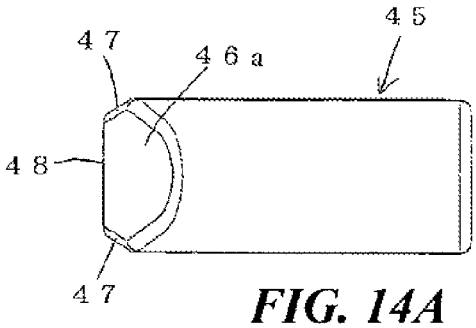
FIGS. 14A to 14E are drawings showing one example of a porous member as a writing part used for a tip of the writing instrument shown in FIGS. 8A and 8B.
Figure 14C:
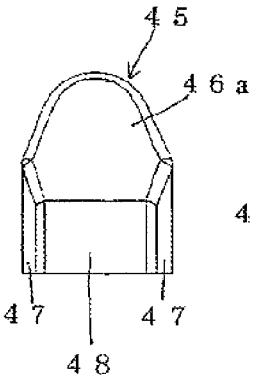
Figure 14B:
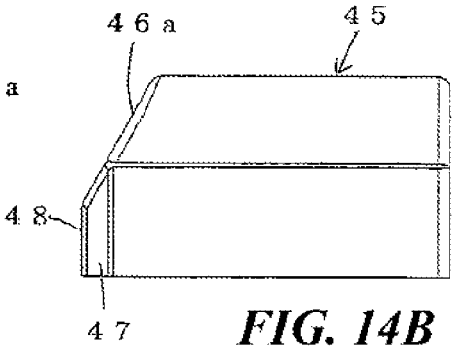
Figure 14D:
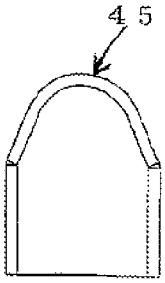
Figure 14E:
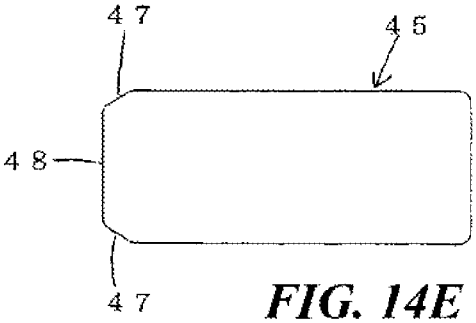
Figure 15D:
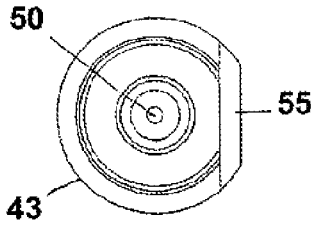
FIGS. 15A to 15D are drawings showing one example of a holding member for holding a porous member as a writing part shown in FIGS. 8A and 8B.
Figure 15A:
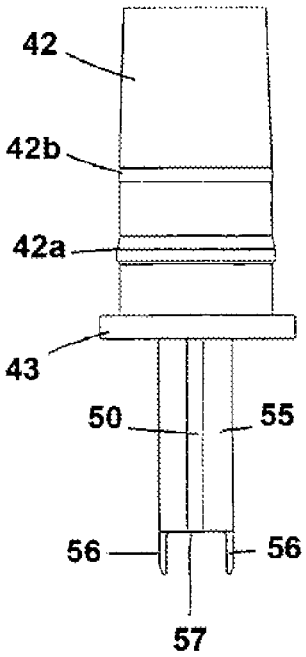
Figure 15B:
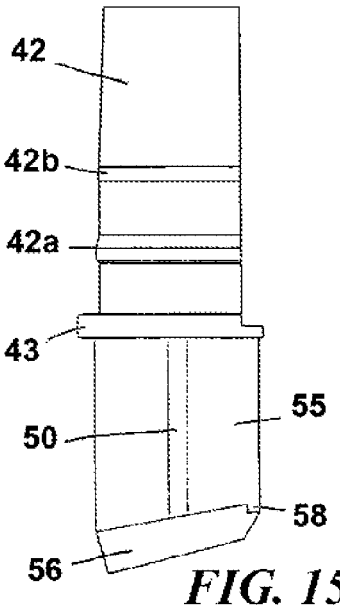
Figure 15C:
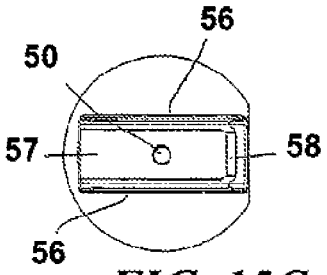
Figure 16A:
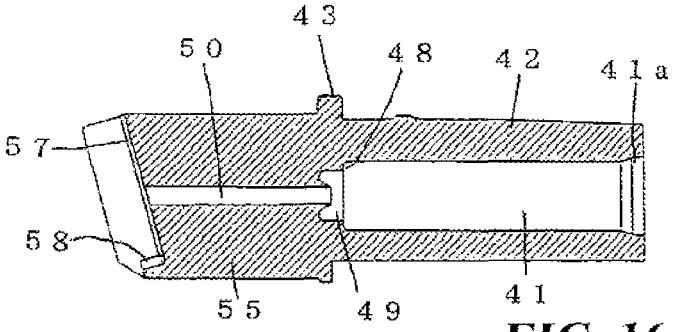
FIGS. 16A to 16C are drawings showing one example of a holding member for holding a porous member as a writing part shown in FIGS. 8A and 8B.
Figure 16B:
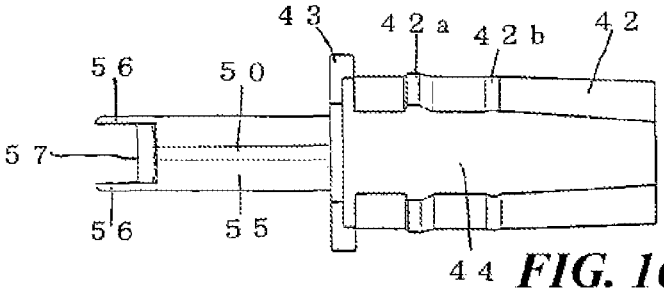
Figure 16C:
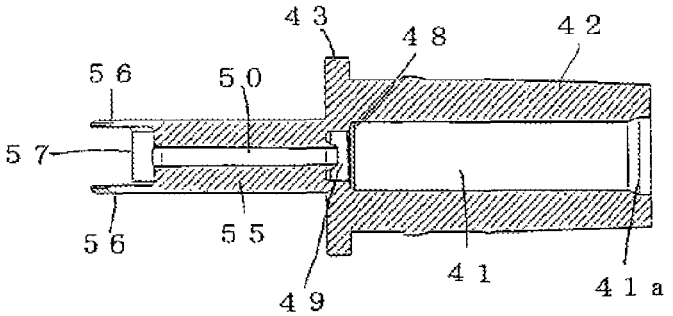
Figure 17D:
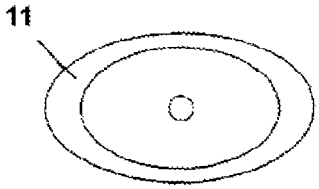
FIGS. 17A to 17E are drawings showing one example of a state in which a cap member is removed from the writing instrument shown in FIGS. 8A and 8B.
Figure 17A:
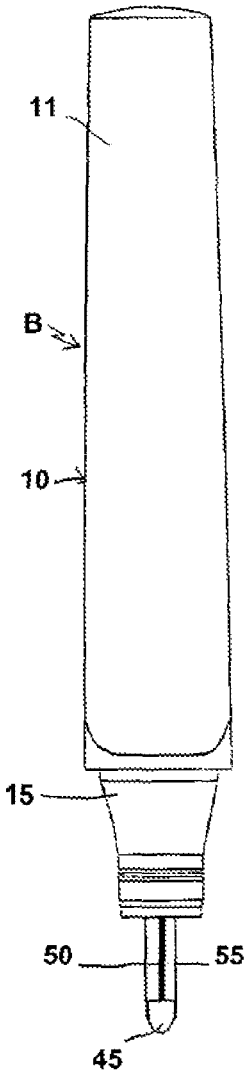
Figure 17B:
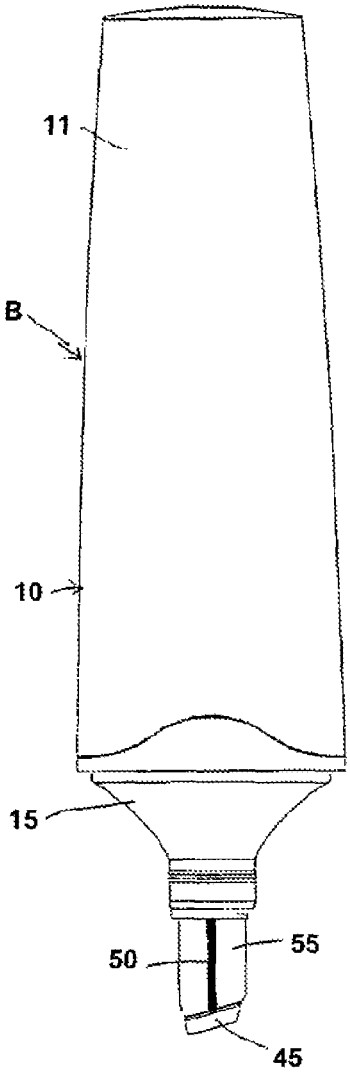
Figure 17C:
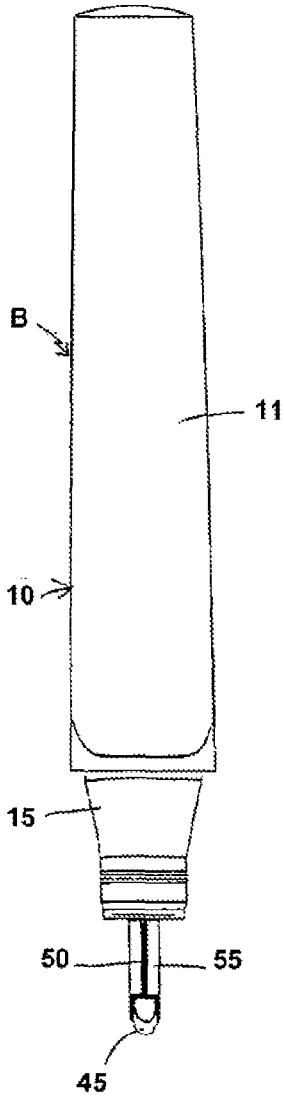
Figure 17E:
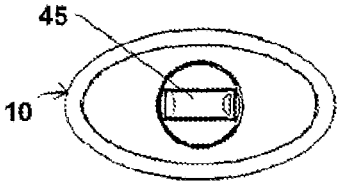
Figure 18A:
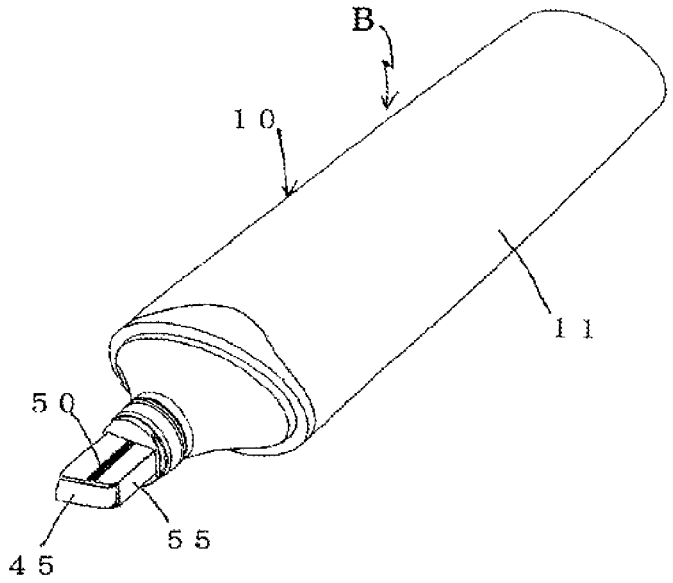
FIGS. 18A and 18B are drawings showing one example of a state in which a cap member is removed from the writing instrument shown in FIGS. 8A and 8B.
Figure 18B:
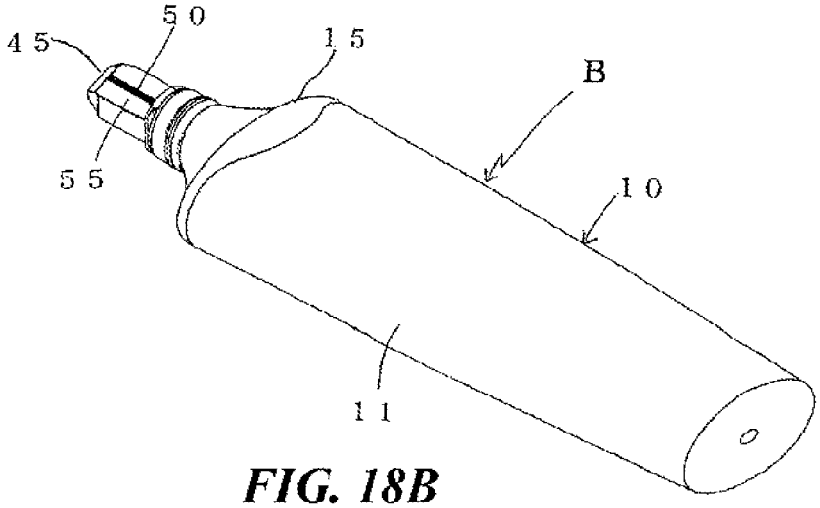
Figure 19D:
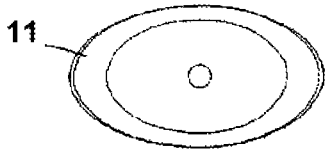
FIGS. 19A to 19D are drawings showing one example of a state in which a cap member is put on the writing instrument shown in FIGS. 8A and 8B.
Figure 19A:
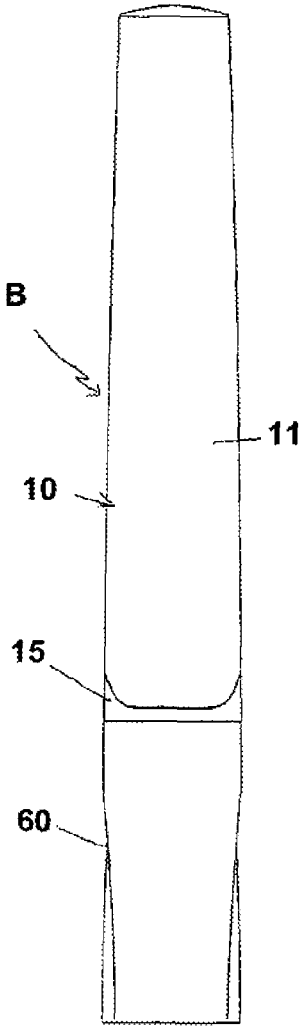
Figure 19B:
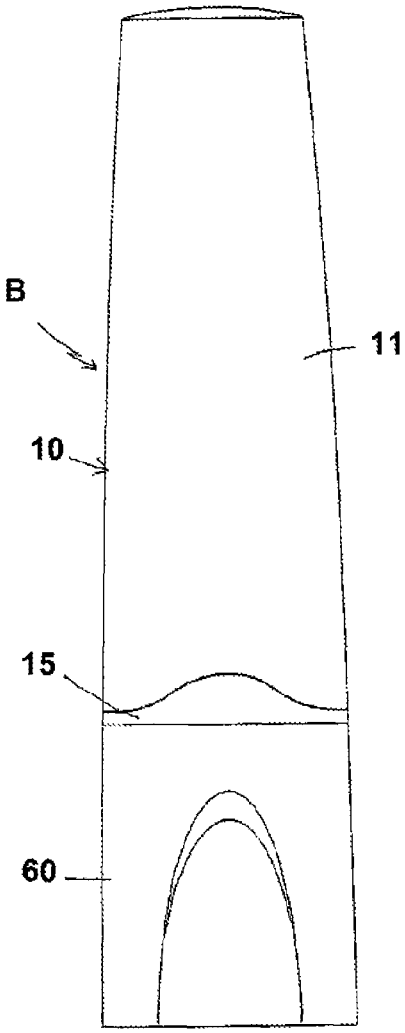
Figure 19C:
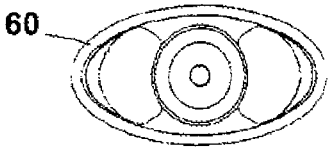

A circular step part 48 with which an end face of the relay porous member 30 at a front side thereof can be brought into contact is formed, as shown in FIG. 13, in a rear position than a rear end of the liquid guiding part 50 at a front side of the cylindrical part 41, and a gap part 49 is formed between the above step part 48 and the relay porous member 30. The above gap part 49 has such a distance that an end face of the relay porous member 30 is not brought into contact with the step part 48, and a length Y in a longitudinal direction falls in a range of preferably $0<Y\leq 2$ mm. In the present embodiment, the gap part is constituted from a gap part of Y=1 mm. Further, in the present embodiment, a convex part 49*a* of an opening type which is smaller than a diameter of the relay porous member 30 and which is larger than a diameter of the liquid guiding part 50 is formed between the step part 48 and the liquid guiding part 50.

The tip 40 of the above structure is endowed with a structure in which an ink from the liquid occulusion body 20 can be continuously fed to the relay porous member 30, the gap part 49, the convex part 49*a*, the liquid guiding part 50 and the porous member (pen feed) 45 as the writing part by a capillary action. A base of the main body part 42 is a flat face chamfered part 44, and inserting convex parts 42*a*, 42*b* for inserting into an inserting part 18 of a front holder 15 are provided in an outer circumference of the main body part 42.

Also, rib members 56, 56 holding the pen feed 45 are provided on both side faces at an upper side of the holding member 55, and a base part 57 brought into contact with a base of the pen feed 45 is provided between the above rib members 56, 56. An outlet of the liquid guiding part 50 is formed in a central part of the above base part 57. Further, a contact part 58 with which a front end face of the pen feed 45 is brought into contact is provided on one end face of the rib members 56, 56, and the other end face is an inlet for inserting the pen feed 45.

A whole part of the tip 40 thus constituted or the holding member 55 described later is constituted, as is the case with the writing instrument A of the embodiment described above, from materials having visibility, for example, materials such as PP, PE, PET, PEN, nylon (including amorphous nylons and the like in addition to conventional nylons such as 6 nylon and 12 nylon), acryl, polymethylpentene, polystyrene, and ABS, and the whole part of the tip 40 or the holding member 55 is constituted preferably from materials having a visible light transmittance of 50% or more. The whole part of the tip 40 or the holding member 55 can be molded, as is the case with the writing instrument A of the embodiment described above, by various molding methods such as injection molding and blow molding.

The porous member (pen feed) 45 as the writing part of the present embodiment is adhered at a front part of the holding member 55, and a form thereof includes, for example, forms such as a chisel form, a shell form, a cylinder, an elliptical cylinder, a cube, a cuboid, and other forms, as is the case with the writing instrument A of the embodiment described above, in terms of an appearance form, and in the present embodiment, the form is a chisel form.

In the above pen feed 45, an inclined plane 46*a* and chamfered parts 47, 47 in holding the liquid guiding part 50 are formed on one end face.

Also, the pen feed 45 as the writing part inclines preferably toward a major axis direction of the main body axis at an angle of 40 to 90° so that an inclination in which the writing instrument is liable to write is provided, and in the present embodiment, the pen feed is mounted at an inclination of 75°.

A form, an inclination and the like of the pen feed 45 as the writing part are suitably set according to the usability such as writing or applying. Also, the pen feed 45 as the writing part has a large drawn line width, and the writing part has a drawn line width of preferably 2 mm or more, more preferably 3 mm or more.

At least one liquid guiding part 50 for feeding an ink to the pen feed 45 as the writing part is present in an inside of the holding member 55 described above, and in the present embodiment, one liquid guiding part 50 is provided, as shown in FIG. 11 and FIG. 12, in the center of a longitudinal direction in a passing-through form from the viewpoints of exerting an area ratio of the visible part to the utmost and feeding efficiently an ink to the porous member as the writing part.

A form, a structure, a size, the number and the like of the above liquid guiding part 50 can suitably be selected as long as the liquid guiding part 50 has a structure in which an ink impregnated in the liquid occulusion body 20 provided in the writing instrument main body can be fed directly to the liquid guiding part via the relay porous member 30 and the gap part 49.

A length W of the liquid guiding part 50 in a cross-sectional width direction is, as is the case with the writing instrument A of the embodiment described above, preferably less than 40%, more preferably 1 to 30% of a major axis length X of the tip from the viewpoints of exerting the effects of the present invention to the utmost, and a cross-sectional area of the liquid guiding part 50 is preferably less than a holding member side cross-sectional area of the writing part or less than a holding member side cross-sectional area of the relay feed 30.

In particular, a length W of the liquid guiding part 50 in a lateral direction is, as is the case with the writing instrument A of the embodiment described above, preferably 3 mm or less, more preferably 0.1 to 2.5 mm from the viewpoint of securing a sufficiently high writing flow amount without damaging visibility of the holding member, and it has preferably a form of a tube having a diameter of preferably 0.1 to 3.0 mm, more preferably 0.2 to 2.5 mm.

Also, a sum of a cross-sectional area of the liquid guiding part 50 in an inside of the holding member 55 is preferably 0.01 to 7 $mm^2$, more preferably 0.03 to 5 $mm^2$.

Further, in the liquid guiding part 50, a taper is preferably formed toward the pen feed 45 as the writing part, and one taper is preferably provided in a direction of 0 to 30° toward a major axis direction of the main body axis.

The liquid guiding part 50 having the structure described above can be formed by the same method as in the writing instrument A of the embodiment described above.

In the above embodiment, the liquid guiding part 50 provided in an inside of the holding member 55 described above has, as is the case with the writing instrument A of the embodiment described above, preferably a visible light transmittance of less than 50% in a state in which an ink for writing described later is accepted therein, and preferably it does not function as a visible part and does not make it possible to visually recognize a writing direction effectively. If an ink can be visually recognized in a state in which the ink is accepted in the liquid guiding part 50, the color components and the like of the ink are limited in use, and ink colors corresponding to the needs are not available, so that it is not preferred.

Also, the holding member 55 other than the liquid guiding part 50 is faces for forming the visible part, and they are preferably almost parallel faces in order to visually recognize a writing direction effectively. The writing direction can be enlarged and visually recognized as well by providing the visible part with a lens face.

In the writing instrument B of the above embodiment, the porous member (pen feed) 45 as the writing part described above can readily be mounted to the holding member 55 in a manner described below as compared with mounting of the porous member as the writing part in the writing instrument A of the embodiment described above.

To be specific, a chamfered part 47, 47 side of the pen feed 45 shown in FIG. 14 is turned to the front; the pen feed 45 is inserted from an aperture part (inlet side) in an opposite side of the contact part 58 at an upper side of the holding member 55 while bringing a bottom of the pen feed 45 into contact with the inner faces and the bottom part 57 of the ribs 56, 56, whereby a front part 48 of the pen feed 45 is brought into contact with the contact part 58, and the pen feed 45 can readily be mounted to an upper face part of the holding member 55.

Conventionally, in mounting the pen feed 45 as the writing part to the holding member 55, the rib faces 56, 56 of the holding member 55 and the pen feed 45 itself are liable to be deformed when the pen feed 45 is not chamfered, and it is difficult to mount the pen feed 45 to the holding member 55. In the present embodiment, however, the pen feed 45 can readily be assembled in holding the liquid guiding part 50 and the pen feed 45 by forming the chamfered parts 47, 47 in an end face of the pen feed 45 and further forming the contact part 58 for holding the pen feed 45 in the holding member 55, and a mounting position of the pen feed can be stabilized.

In mounting the pen feed 45 described above, the resin for forming the holding member is sintered, as is the case with the writing instrument A of the embodiment described above, from the holding member 55 into pores of the porous member 45 at a part at which the porous member 45 is brought into contact with the holding member 55 to form a holding member resin layer from the viewpoint of firmly adhering the porous member 45 in a state of providing it with a sealing performance, whereby the porous member 45 and the holding member 55 are preferably adhered.

In the above case, the porous member 45 and the holding member 55 having the liquid guiding part 50 can be adhered in the same manner as in the writing instrument A of the embodiment described above by the materials forming the porous member 45 and the holding member 55.

A holding member resin layer (the holding member resin layer in an interface is referred to as an adhesion face) is preferably formed, as is the case with the writing instrument A of the embodiment described above, in an end face of the liquid guiding part 50 at a side of the pen feed 45 as the writing part in an interface between the porous member 45 and the holding member 55, and the above adhesion face is preferably formed toward a whole direction of the end face in a length of 0.5 mm or more, more preferably 0.8 to 3 mm.

The above adhesion face can be formed, as is the case with the writing instrument A of the embodiment described above, in any of a plane, a curved surface and a bent part, and the adhesion face is preferably formed in an end face of the liquid guiding part 50 at a writing part pen feed 45 side in a length of 0.5 mm or more, more preferably 0.8 to 3 mm over a whole periphery of the above end face.

Also, the holding member resin layer on the adhesion face is preferably formed in a depth of 1 to 1000 μm, more preferably 10 to 800 μm toward an inside of the pen feed 45, and a surface of a local peak in a contact part of the holding member 55 brought into contact with the pen feed 45 is preferably turned into a satin finished surface state by surface texturing and the like.

FIG. 11 to FIG. 13 are the respective drawings of a state in which the porous member 45 as the writing instrument and the holding member 55 having the liquid guiding part 50 are adhered.

FIG. 17 and FIG. 18 are the respective drawings showing one example of a state in which a cap member is removed in the writing instrument B of the above embodiment; FIG. 19 and FIG. 20 are the respective drawings showing one example of a state in which the cap member is attached; and FIG. 21 shows the respective drawings of the cap member.

In the writing instrument B of the above embodiment, the liquid occulusion body 20 absorbing an ink, the tip 40 which holds the relay feed 30 so that the gap part 49 is formed and which is equipped with the pen feed 45 and the front holder 15 are mounted in order in the rear barrel 11 by interfitting and the like, whereby the writing instrument can readily be produced.

The cap member 60 is detachably mounted in the front holder by interfitting and the like and constituted from an inner cap part 61 protecting the tip 45 and a cylindrical outer cap part 62, and it has a structure in which a concave part 63 for enhancing a design property is formed on a surface of the outer cap part 62. Also, an opening face at a front side of the outer cap part 62 is, as shown in FIG. 20, a wide opening face so that it is provided with a structure in which it can be stood on a flat face of a desk and the like, and in the present embodiment, it is an elliptical opening face having a lateral direction length of 1.5 cm, a longitudinal direction length of 2.8 cm and a thickness of 1 mm.

In the writing instrument B of the present embodiment thus constituted, the pen feed 45 can readily be set up into the holding member 55 by forming the chamfered parts 47, 47 in an end face of the pen feed 45 in holding the liquid guiding part 50 in the porous member (pen feed) 45 as the writing part and further forming the contact part 58 for holding the pen feed 45 in the holding member 55, and a mounting position of the pen feed 45 can be stabilized.

Also, in the writing instrument B of the present embodiment, the gap part 49, preferably the gap part in which a length Y in a longitudinal direction is $0<Y\leq 2$ mm is formed between the circular step part 48 with which an end face of the relay porous member 30 as a feed can be brought into contact and the feed 30, whereby an ink from the liquid occulusion body 20 can be fed continuously and efficiently to the feed 30, the gap part 49 (and the convex part 49*a*), the liquid guiding part 50 and the pen feed 45 by a capillary action, and therefore obtained is the writing instrument in which a suitable ink flow amount is secured to prevent blurring in writing and stabilize a writing flow amount and in which an ink stored in the liquid occulusion body can sufficiently be exhausted. Forming further the convex part 49*a* of an opening type which is smaller than a diameter of the relay porous member 30 and larger than a diameter of the liquid guiding part 50 between the step part 48 and the liquid guiding part 50 in the above gap part 49 makes it possible to further secure a suitable ink flow amount, further prevent blurring in writing and further enhance stabilization of a writing flow amount.

Also, the tip 40 is equipped, as described above, with the pen feed 45 as the writing part and the holding member 55 holding the above pen feed 45 and having at least one liquid guiding part 50 for feeding an ink to the writing part, and it has the relay porous member 30 for feeding the ink contained in the liquid occulusion body 20 to the liquid guiding part 50 provided in the holding member 55. The holding member 55 described above is constituted by a material having visibility, and therefore in the above holding member 55, a whole face (whole part) other than the liquid guiding part 50 is, as shown in FIG. 17, FIG. 18 and the like, a visible part in which a writing direction can be visually recognized. An area ratio of the visible part can be 40% or more of the tip protruding from a tip part of the front holder 15, and an area ratio of the visible part on a side face of the holding member 55 at the tip is controlled as well to 40% or more. Further, an area ratio of the visible part can be controlled to 50% or more by forming the liquid guiding part 50 in a central part of a longitudinal direction of the holding member 55 and setting a length, a diameter, a cross-sectional area and the like of the liquid guiding part 50 in a lateral direction to the preferred ranges described above, and provided is the writing instrument which can be endowed with a sufficiently high visibility making it possible to read characters written toward a writing direction more surely than ever and which can be used to end of writing. In particular, the ink can efficiently be fed evenly to the porous member 45 as the writing part by forming the liquid guiding part 50 in a central part of a longitudinal direction of the holding member 55, and therefore the writing instrument which can be further used to end of writing is provided.

Also, the form in which a writing direction is liable to be determined and in which the writing instrument is liable to write is obtained by forming the liquid guiding part 50 in a central part of a longitudinal direction of the holding member 55. Further, providing the rib members 56, 56 on an upper part of the holding member 55 makes it possible to draw straight lines without staining the ruler when drawing them with a ruler.

Further, an ink can efficiently be fed to the porous member 45 as the writing part by employing a mechanism in which a liquid is fed directly to the liquid guiding part 50. When a porous member is used as the liquid guiding part 50, a suitable ink flow amount is not obtained in a certain case.

Figure 22:
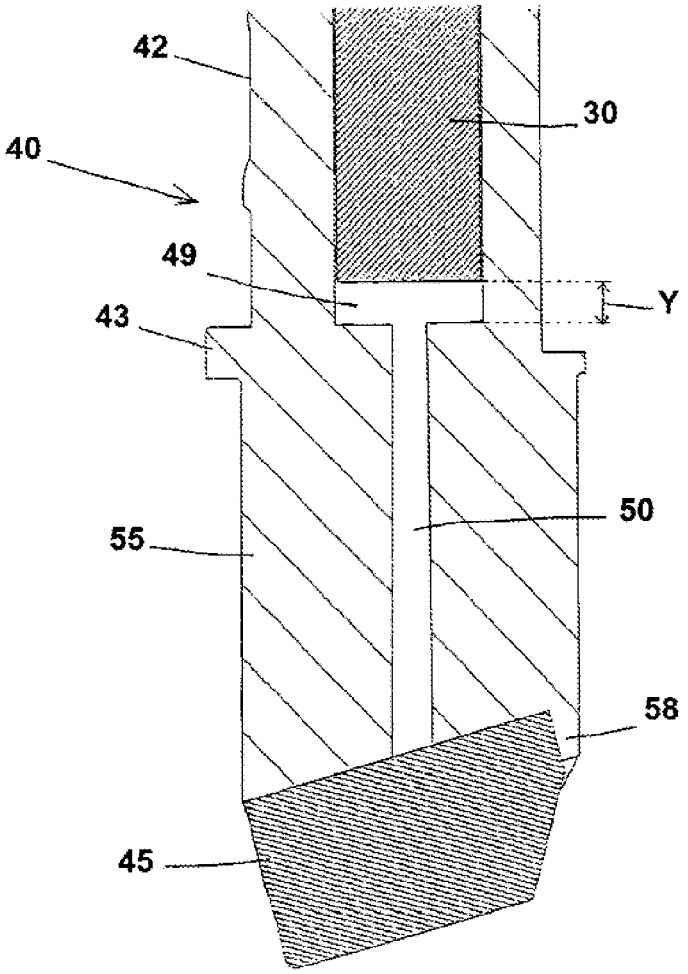
FIG. 22 is an enlarged central lateral cross section showing another form of the tip shown in FIG. 12A.
Figure 24:
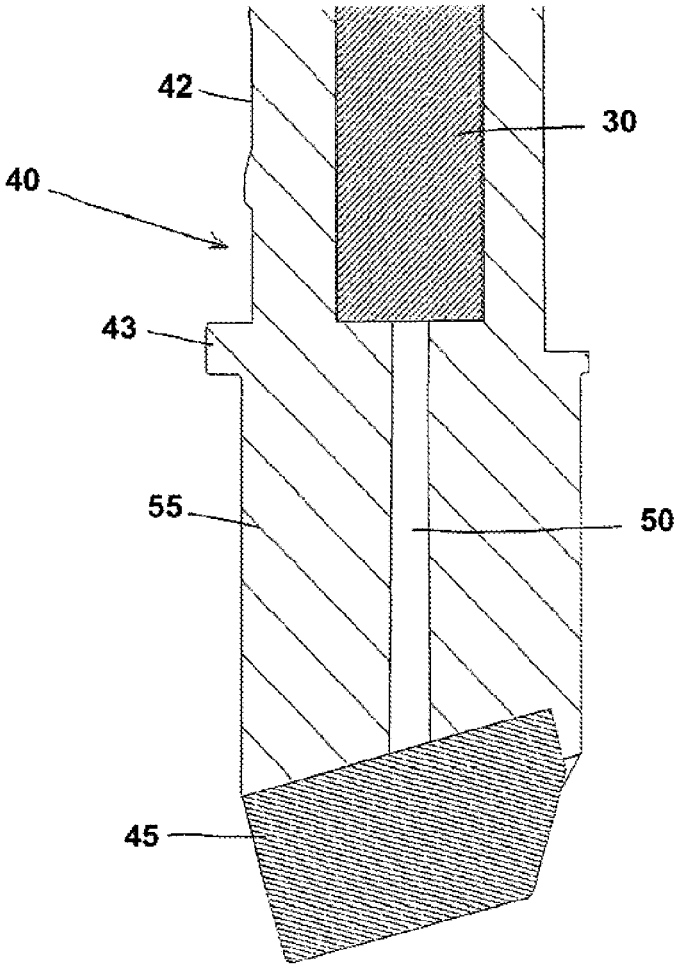
FIG. 24 is an enlarged central lateral cross section showing a form of a tip having no gap part which is used in a reference example.
Figure 25:
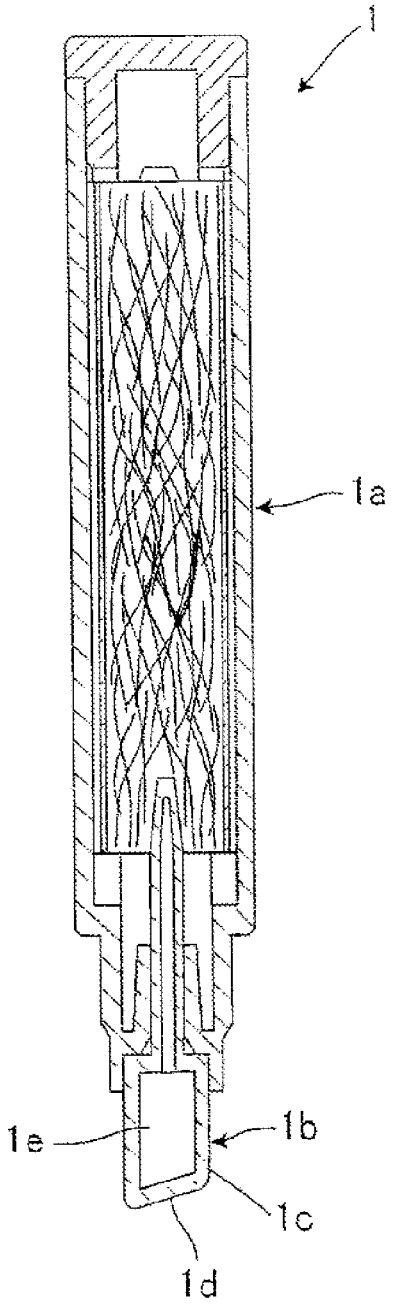
FIG. 25 PRIOR ART
FIG. 25 is a vertical cross section of a writing instrument showing one example of a conventional writing instrument.
Figure 26A:
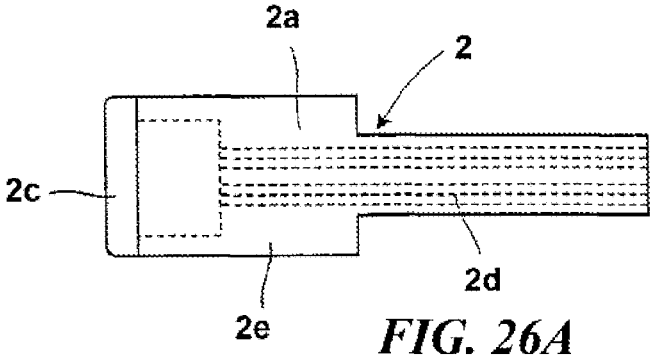
FIG. 26A PRIOR ART
FIGS. 26A and 26B are a front view and a lateral cross section showing one example of a tip in the conventional writing instrument shown in FIG. 25.
Figure 26B:
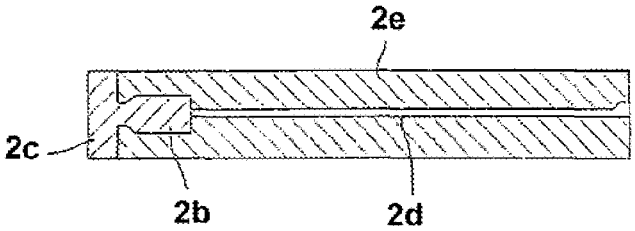
FIG. 26B PRIOR ART
Figure 27A:
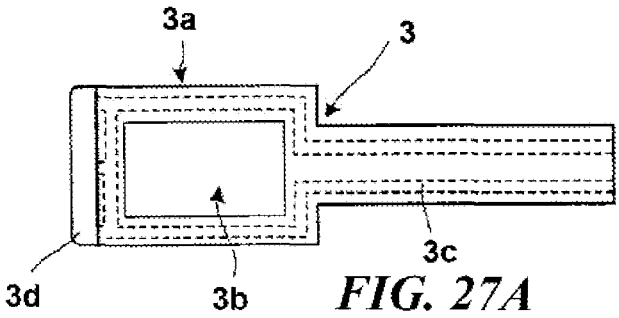
FIG. 27A PRIOR ART
FIGS. 27A and 27B are a front view and a lateral cross section showing another example of a tip in the conventional writing instrument shown in FIG. 25.
Figure 27B:
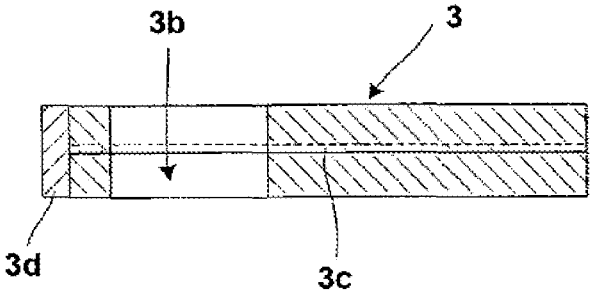
FIG. 27B PRIOR ART
Figure 28A:
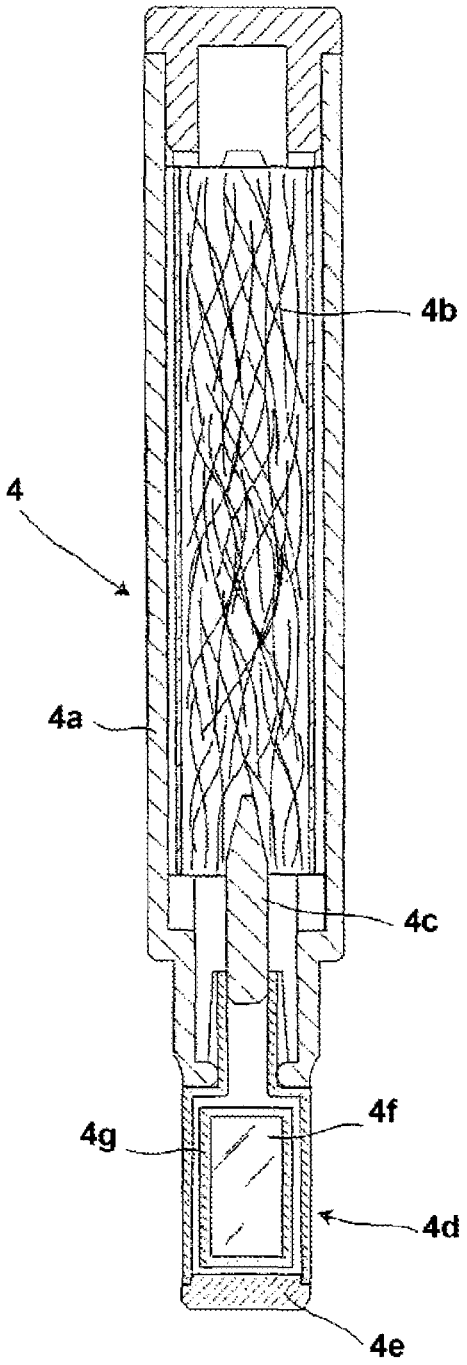
FIG. 28A PRIOR ART
FIGS. 28A and 28B are a lateral cross section of a writing instrument showing one example of a conventional writing instrument and a lateral cross section showing one example of a tip in the writing instrument.
Figure 28B:
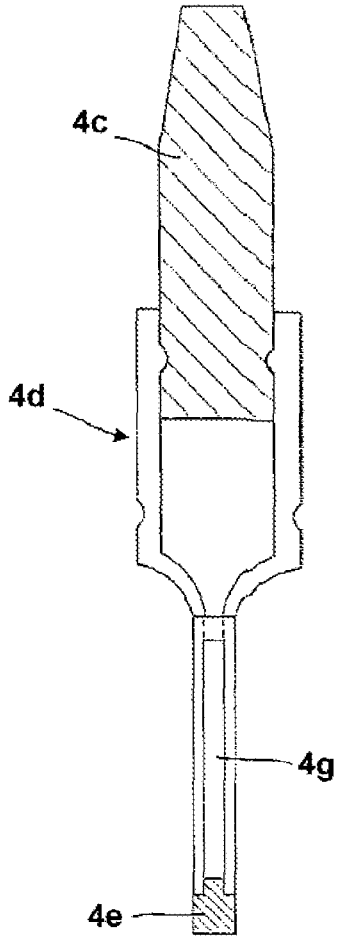
FIG. 28B PRIOR ART
Figure 29A:
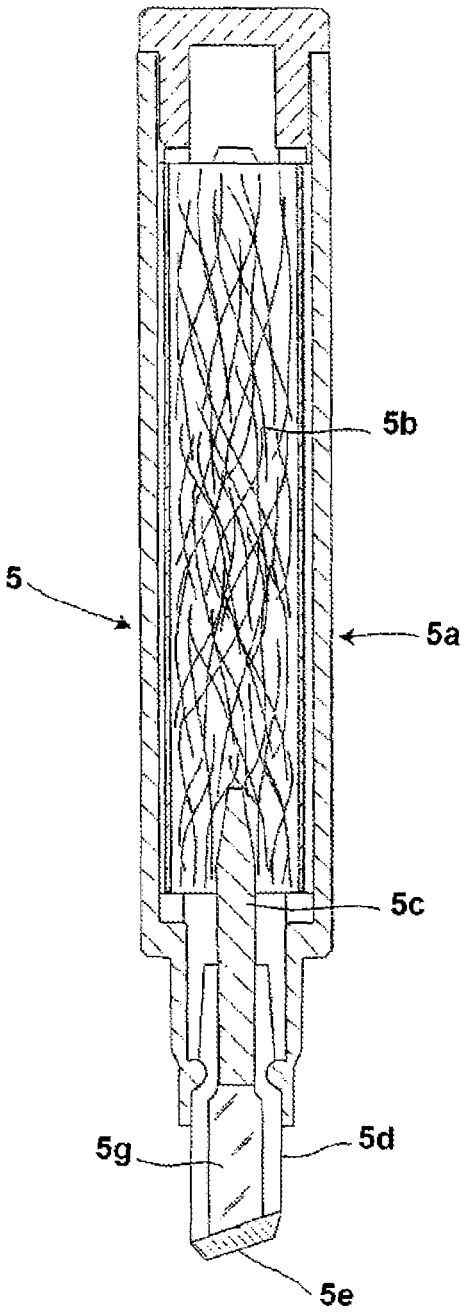
FIG. 29A PRIOR ART
FIGS. 29A and 29B are a lateral cross section of a writing instrument showing one example of a conventional writing instrument and a lateral cross section showing one example of a tip in the writing instrument.
Figure 29B:
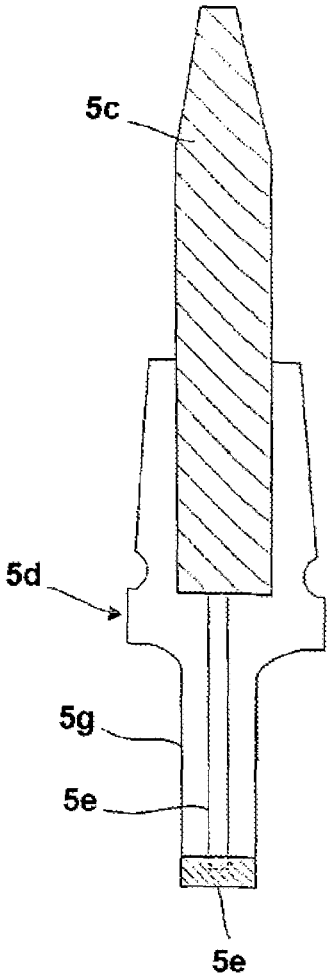
FIG. 29B PRIOR ART

In the writing instrument B of the embodiment described above, taken is a structure in which the ink from the liquid occulusion body 20 can be continuously fed to the relay porous member 30, the gap part 49, the convex part 49*a*, the liquid guiding part 50 of the holding part 55 and the pen feed 45 by a capillary action, and the convex part 49*a* may be omitted without providing to feed, as shown in FIG. 22, the ink from the liquid occulusion body 20 to the relay porous member 30, the gap part 49, the liquid guiding part 50 and the pen feed 45 by a capillary action. As shown in FIG. 24, when the gap part is not formed, securing of a suitable ink flow amount, blurring in writing, stabilization of a writing flow amount and the like are, as is the case with a reference example described later, a little inferior. In FIG. 22 and FIG. 24, constitutions common to that in FIG. 13 are shown by the same numerals to omit explanations thereof.

Also, in the writing instrument B of the embodiment described above, the barrel of the writing instrument main body is formed in an elliptical cross-sectional form, but it may be circular, triangle and polygonal more than square.

Further, in the writing instrument B of the embodiment described above, the writing instrument in which the liquid guiding part 50 is formed in a linear form toward a major axis direction is described in detail, but the liquid guiding part 50 in the tip 40 can be formed as well in the respective forms shown in FIGS. 6A to 6D and FIGS. 7A and 7B to make it liable to be visually recognized.

Next, the present invention shall be explained in further details with reference to examples and comparative examples, but the present invention shall not be restricted to the examples shown below.

Test Example 1

Examples 1 to 4 and Comparative Examples 1 to 6

Figure 23:
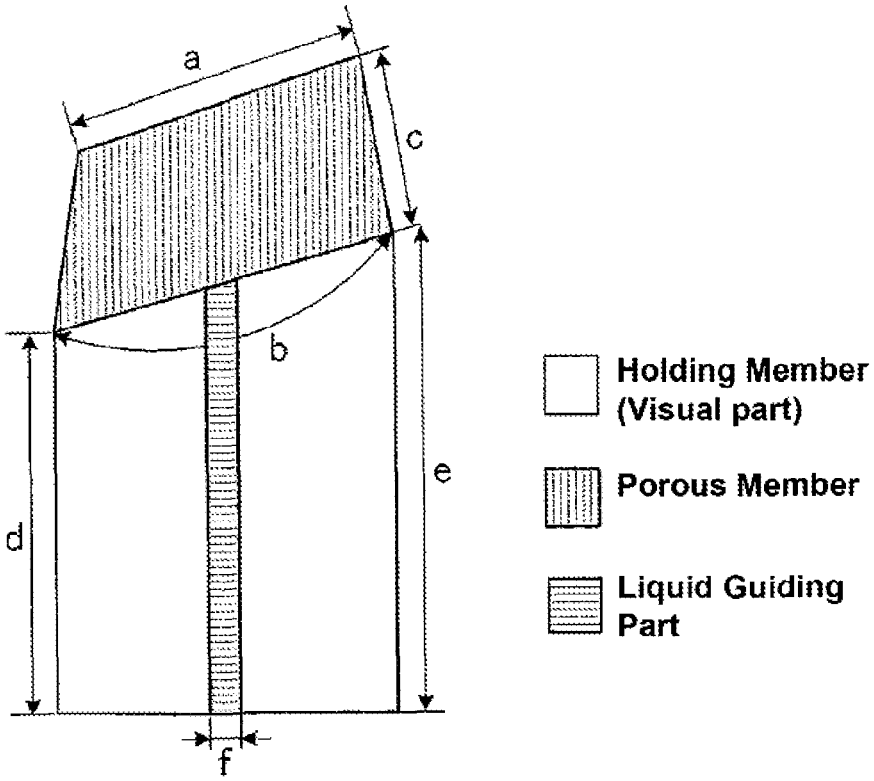
FIG. 23 is a front view showing the respective dimensions of a tip used for the writing instruments in the examples of the present invention and the comparative examples.

A writing instrument equipped with a tip having the following composition and an ink were used. The respective sizes shown in the following Table 1 and FIG. 23 were used for the dimensions of a porous member as a writing part, a holding member and a liquid guiding part which constitute the respective tips. Common ones were used for writing instrument members other than the tip and the ink.

Constitution of Tip:

Writing part porous member: PE-made sintered feed, porosity: 60%

Holding member: acryl-made, visible light transmittance: 85% (reflectance was measured by means of a multi-illuminant colorimeter (MSC-5N) manufactured by Suga Test Instruments Co., Ltd. to determine a visible light transmittance, hereinafter the same shall apply).

An area (area ratio) of the visible parts in the respective tips was calculated by measuring an actual dimension of the molded article. An area (area ratio) of the visible parts in the respective tips is shown in the following Table 1.

Liquid guiding part: cylindrical form, the respective diameters described in the following Table 1, a visible light transmittance in a state in which the ink was contained therein: 27% (common) Constitution of writing instrument members other than the tip:

Relay porous member: PET fiber bundle, porosity: 65%, ϕ4×25 mm

Liquid occulusion body: PET fiber bundle, porosity: 85%, ϕ14×55 mm

Writing instrument main body, plug and cap: polypropylene (PP)-made

The relay porous member, the writing part porous member and the holding member were adhered in the following manner.

The relay porous member and the writing part porous member were adhered by impregnating them with an organic solvent (ethyl acetate) in a state in which the respective porous members were temporarily inserted into the holding member and then drying them.

A porous member of a PET fiber bundle, a porosity: 65% and ϕ1.5×8 mm was used as the porous member of the liquid guiding part in Comparative Example 3.

Comparative Example 5 is based on FIG. 1 (FIG. 28 in the present application) of patent document 6 (Japanese Patent Application Laid-Open No. 69426/2007) which is a conventional technique, and Comparative Example 6 is based on FIG. 1 (FIG. 29 in the present application) of patent document 7 (Japanese Patent Application Laid-Open No. 69427/2007) which is s conventional technique. The tips of the materials and the sizes described in each Example 1 of the respective patent documents were used.

Ink Composition, Common:

A fluorescent rosy ink was used as the ink.

| | |
|---|---|
| Color material: VC Toner Momo (manufactured by Mikuni Color Ltd.) | 30 parts by mass |
| Wetting agent: glycerin | 25 parts by mass |
| Preservative: Bioace (manufactured by KI Chemical Industry Co., Ltd.) | 0.7 part by mass |
| Ion-exchanged water | 44.3 parts by mass |

The respective tips having the constitution described above were used to evaluate visibility and an ink flow amount by the following evaluation methods.

The evaluation results thereof are shown in the following Table 1.

Evaluation Method of Visibility:

Writing was carried out on characters, and an extent of seeing an opposite side via the visible part in writing was visually confirmed to evaluate the visibility according to the following evaluation criteria.

Evaluation Criteria of Visibility:

○: satisfactory visibility; very easy to see, and writable while reading characters written toward a writing direction.

Δ: unsatisfactory visibility; visible to some extent, but have to visually recognize them carefully in order to read characters written toward a writing direction.

X: unsatisfactory visibility; partially visible but invisible in ordinary use.

Evaluation Method of Ink Flow Amount:

The writing instrument was set in an automatic writing equipment to write a straight line on a wood free paper face at a writing angle of 65°, a writing force of 1 N and a speed of 7 cm/s in a distance of 20 m according to JIS S6037, and then a state of the written line was visually confirmed to evaluate the ink flow amount according to the following evaluation criteria.

Evaluation Criteria of Ink Flow Amount:

○: good writing property and no blurring in the drawn lines.

Δ: unsatisfactory writing property and blurring in the drawn lines.

X: unsatisfactory writing property and marked blurring in the drawn lines.

TABLE 1

| | Writing part size a/b/c (mm) | Holding member size d/e/f (mm) | Ink guiding part diameter W (mm) | Ink guiding part system | Visible part area ratio (%) | Visibility | Ink flow amount |
|---|---|---|---|---|---|---|---|
| Example 1 | 5.1/5.9/2.5 | 6.5/8.0/6.0 | ϕ0.7 | free ink | 67 | ○ | ○ |
| Example 2 | 5.1/5.9/2.5 | 6.5/8.0/6.0 | ϕ2.3 | free ink | 48 | ○ | ○ |
| Example 3 | 5.1/5.9/2.5 | 5.0/6.5/6.0 | ϕ0.15 | free ink | 75 | ○ | ○ |
| Example 4 | 5.1/5.9/4.0 | 5.1/6.5/6.0 | ϕ1.4 | free ink | 42 | ○ | ○ |
| Comparative Example 1 | 5.1/5.9/4.0 | 5.0/6.5/6.0 | ϕ1.8 | free ink | 37 | Δ | ○ |
| Comparative Example 2 | 5.1/5.9/2.5 | 6.5/8.0/6.0 | ϕ0.08 | free ink | 74 | ○ | X |
| Comparative Example 3 | 5.1/5.9/2.5 | 6.5/8.0/6.0 | ϕ1.4 | porous member | 59 | ○ | X |
| Comparative Example 4 | 5.1/5.9/2.5 | 6.5/8.0/6.0 | Φ3.2 | free ink | 22 | ○ | X |
| Comparative Example 5 | Japanese Patent Application Laid-Open No. 69426/2007, FIG. 1 (FIG. 28 in the present application) | | | free ink | 34 | X | ○ |
| Comparative Example 6 | Japanese Patent Application Laid-Open No. 69427/2007, FIG. 1 (FIG. 29 in the present application) | | | free ink | 35 | X | ○ |

As apparent from the results of Table 1 described above, it has become clear that in Examples 1 to 4 falling in the scope of the present invention, provided are writing instruments which can be endowed with a sufficiently high visibility making it possible to read characters written toward a writing direction more surely than ever and which can be used to end of writing as compared with writing instruments in Comparative Examples 1 to 6 falling outside the scope of the present invention.

In Comparative Examples 5 and 6 (Japanese Patent Application Laid-Open No. 69426/2007, FIG. 28 in the present application, Japanese Patent Application Laid-Open No. 69427/2007, FIG. 29 in the present application), a writing direction can be visually recognized via a free liquid guiding part, but it is hard to be visually recognized in ordinary use such as writing, and the satisfactory visibility cannot be endowed.

Test Example 2

Examples 5 to 7 and Comparative Examples 7 to 8

In Test Example 2, the writing part porous member and the holding member were adhered by changing an adhered face form, adhered face dimensions and an adhered face shortest length to evaluate an adhesive strength and a sealing performance by the following evaluation methods. The evaluation results thereof are shown in the following Table 2.

A writing instrument equipped with the tip used in Example 1 described above and produced by the following method was used. The writing part porous member was adhered to the holding member by the following method.

The relay porous member and the writing part porous member were adhered by impregnating them with an organic solvent in a state in which the respective porous members were temporarily inserted into the holding member and then drying them.

Evaluation Method of Adhesive Strength:

The writing part porous member adhered was peeled off with a hand covered with a rubber glove and evaluated according to the following evaluation criteria.

Evaluation Criteria of Adhesive Strength:

○: satisfactory adhesive strength, and when the writing part porous member is tried to be peeled off, the writing part porous member is broken before the adhered part is peeled off.

Δ: adhesive strength of a level in which it stands ordinary use; short of an adhesive strength; when the writing part porous member is tried to be peeled off, the writing part porous member itself is peeled off; and it is not peeled off in writing.

X: short of an adhesive strength, and the writing part porous member is peeled off from the holding member in writing.

Evaluation Method of Sealing Performance:

The sealing performance was evaluated by whether or not sealing was broken in writing and whether or not sealing was broken in allowing the writing instrument to freely fall from a height of 150 cm onto a concrete floor with the tip turned upward according to the following evaluation criteria. When sealing is broken, air (air bubbles) gets into a free liquid guiding part, and therefore it can be visually confirmed.

Evaluation Criteria of Sealing Performance:

○: no problem on sealing performance.

Δ: sealing is broken by drop impact and the like, and fine air bubbles get into the liquid guiding part.

X: sealing is broken by drop impact and the like, and large air bubbles get into the liquid guiding part.

TABLE 2

| | Adhered face form | Adhered face dimension | Ink guiding part | Adhered face Shortest length | Adhesive strength | Sealing performance |
|---|---|---|---|---|---|---|
| Example 5 | rectangle | 3 mm × 6 mm | diameter: 1 mm | 1 mm | ○ | ○ |
| Example 6 | circle | diameter: 6 mm | diameter: 1 mm | 2.5 mm | ○ | ○ |

TABLE 2-continued

| | Adhered face form | Adhered face dimension | Ink guiding part | Adhered face Shortest length | Adhesive strength | Sealing performance |
|---|---|---|---|---|---|---|
| Example 7 | bent face | bottom: 1.6 × 6 mm side face: 1 × 6 mm | diameter: 1 mm | 1.3 mm | ○ | ○ |
| Comparative Example 7 | rectangle | 1.6 mm × 6 mm | diameter: 1 mm | 0.3 mm | Δ | X |
| Comparative Example 8 | circle | diameter: 1.6 mm | diameter: 1 mm | 0.3 mm | Δ | X |

As apparent from the results of Table 2 described above, it has become clear that in Examples 5 to 7 falling in the scope of the present invention, the writing instruments are excellent in an adhesive strength and a sealing performance as compared with the writing instruments in Comparative Examples 7 to 8 falling outside the scope of the present invention.

Test Example 3

Examples 8 to 10 and Comparative Examples 9 to 10

In Test Example 3, the adhesive strength and the sealing performance depending on the thickness of the holding member resin layer were evaluated by the evaluation methods described above. The evaluation results thereof are shown in the following Table 3.

Used was a writing instrument equipped with the tip used in Example 1 described above and produced by using the same method as in Test Example 2 described above, except that only a thickness of the holding member resin layer was changed.

TABLE 3

| | Thickness of the holding member resin layer | Adhesive strength | Sealing performance | Remarks |
|---|---|---|---|---|
| Example 8 | 10 μm | ○ | ○ | — |
| Example 9 | 100 μm | ○ | ○ | — |
| Example 10 | 800 μm | ○ | ○ | — |
| Comparative Example 9 | less than 1 μm | X | X | not adhered |
| Comparative Example 10 | 1500 μm | ○ | Out of standard | liquid guiding part clogged |

As apparent from the results of Table 3 described above, it has become clear that in Examples 8 to 10 falling in the scope of the present invention, the writing instruments are excellent in an adhesive strength and a sealing performance as compared with the writing instruments in Comparative Examples 9 to 10 falling outside the scope of the present invention. When a thickness of the holding member resin layer was less than 1 μm, the holding member resin layer could not be confirmed and stayed in a state in which the holding member could not be adhered. In the writing instrument of Comparative Example 9 in which a thickness of the holding member resin layer was 1500 μm, the liquid guiding part was clogged, and the ink flow amount was reduced very much.

Example 11

A writing instrument equipped with a tip having the following constitution and based on FIG. 8 to FIG. 21 and the ink having the composition described above were used. A pen feed as a writing part constituting the tip, a holding member, a liquid guiding part and the like each having sizes shown below were used.

Constitution of Tip:

Writing part tip: PE-made sintered feed, porosity: 60%, upper side length: 5 mm, lower side length: 6 mm, height: 3 mm, both sides of front end face 48 subjected to chamfering treatment.

Holding member (including a main body part): acryl resin-made, visible light transmittance: 85% (reflectance was measured by means of a multi-illuminant colorimeter (MSC-5N), manufactured by Suga Test Instruments Co., Ltd. to determine a visible light transmittance).

An area (area ratio) of the visible part in the tip was calculated by measuring an actual dimension of the molded article to find that an area (area ratio) thereof was 90%. Length X: 11 mm, a thickness: 3.2 mm and a lateral direction length: 6.8 mm.

Liquid guiding part: cylindrical form, diameter W: 0.7 mm, length: 7.1 mm, a visible light transmittance in a state in which the ink was contained therein: 27% Constitution of writing instrument members other than the tip:

Relay feed: PET fiber bundle, porosity: 65%, ϕ3×24 mm

Gap part Y: 1 mm, size and the like of convex part 49*a*: ϕ2×1 mm

Liquid occulusion body: PET fiber bundle, porosity: 85%, ϕ13×55 mm

Writing instrument main body and cap: polypropylene (PP)-made

The pen feed was adhered to the holding member in the following manner.

As described in detail in the embodiment, the pen feed was adhered by impregnating the pen feed with an organic solvent (ethyl acetate) in a state in which the pen feed was mounted in the holding member from a chamfered part side and then drying thereof.

Example 12

Used was a writing instrument in which only the tip shown in FIG. 13 was changed to that shown in FIG. 22 in the writing instrument used in Example 11 described above, to be specific, a writing instrument equipped with the tip provided with the gap part 49 having no convex part 49*a*. The respective dimensions of the pen feed, the relay feed and the liquid occulusion body are the same as those in Examples 11 described above, and the same ink was used.

Reference Example

Used was a writing instrument in which only the tip shown in FIG. 13 was changed to that shown in FIG. 24 in the writing instrument used in Example 11 described above, to be specific, a writing instrument equipped with the tip which did not have the gap part 49 and the convex part 49*a* and in which an end face of the relay feed was brought into contact with an end face of the liquid guiding part. The respective dimensions of the pen feed, the relay feed and the liquid occulusion body are the same as those in Examples 1 and 2 described above, and the same ink was used.

The respective writing instruments obtained in Example 11, Example 12 and Reference Example each described above were used to evaluate an ink flow amount by the following evaluation method.

Evaluation Method of Ink Flow Amount:

The respective writing instruments were set in an automatic writing equipment to write a straight line on a wood free paper face at a writing angle of 65°, a writing force of 1 N and a speed of 7 cm/s in a distance of 100 m according to JIS 56037, and then a state of the written line was visually confirmed to evaluate the ink flow amount according to the following evaluation criteria. In the present evaluation method, the writing distance was changed from 20 m to 100 m as compared with the evaluation method of the ink flow amount in Examples 1 to 4 described above.

Evaluation Criteria of Ink Flow Amount:

⊙: good writing property and no blurring in the drawn lines up to 100 m.

Δ: unsatisfactory writing property and blurring in the drawn lines.

X: unsatisfactory writing property and marked blurring in the drawn lines.

In the evaluation of the ink flow amounts in the respective writing instruments used in Examples 11 and 12 and Reference Example each described above, given were "⊙" to Example 1, "⊙" to Example 2 and "Δ to X" to Reference Example.

Accordingly, in the writing instrument of Example 11 (FIG. 13) in which the gap part and the convex part were formed between the step part and the relay feed in the tip and the writing instrument of Example 12 (FIG. 22) in which the gap part was formed, an ink from the liquid occulusion body 20 could be fed continuously and efficiently to the relay feed, the gap part (and the convex part), the liquid guiding part and the pen feed by a capillary action, and therefore it was found that obtained was a writing instrument in which a suitable ink flow amount was secured to prevent blurring in writing and make it possible to contribute to stabilization of a writing flow amount.

In contrast with this, it was found that in the writing instrument of Reference Example (FIG. 24) in which an end face of the relay feed is brought into contact with an end face of the liquid guiding part, blurring in writing was observed in the evaluation of the ink flow amount up to a distance of 100 m and that the writing instrument was inferior in stabilization of a writing flow amount In the writing instruments of Examples 11 and 12 described above, a chamfered part was formed in an end face of the pen feed 45 in holding the liquid guiding part 50 and the pen feed 45, and the contact part 58 for holding the pen feed 45 in the holding member 55 was formed. Accordingly, the pen feed 45 was readily set up into the holding member 55, and a mounting position of the pen feed 45 could be stabilized.

Also, the writing instruments obtained in Examples 11 and 12 were used to write on characters, and an extent of seeing an opposite side via the visible part in writing was visually confirmed to find that a visible part area (area ratio) of the tip was 90%. Accordingly, the writing instruments had a satisfactory visibility to make seeing very easy and could write while reading characters written toward a writing direction.

Further, the writing instruments of Examples 11 and 12 were used to evaluate whether or not sealing was broken in allowing the writing instrument to freely fall from a height of 150 cm onto a concrete floor with the tip turned upward to find that air did not get into the liquid guiding part by drop impact and that the writing instruments had a good writing performance and caused no problems on a sealing performance.

The writing instruments of the present invention can suitably be used for writing instruments of types called an underline pen, a paint marker, an oil-based marker and an aqueous marker. In addition thereto, the writing instrument of the present invention is applicable to the applicator of the liquid such as an aqueous cosmetic, an oil-based cosmetic, and including an emulsified cosmetic thereof, having a viscosity from 1 to 15 mPa·s.

The invention claimed is:

1. An applicator in which a tip is equipped with a porous member as an applying part and a holding member holding the above porous member and having at least one liquid guiding part for feeding a liquid to the applying part, which comprises a relay porous member for feeding a liquid contained in an applicator main body to the liquid guiding part provided in a central part of a longitudinal direction of the holding member and in which the holding member is a visible part enabling to visually recognize an applying direction, wherein an area ratio of the above visible part on a front face is 40% or more of the tip protruding from a tip part of the applicator main body, and an area ratio of the visible part on a side face of the holding member in the tip is 40% or more, the liquid guiding part is less than a holding member side cross-sectional area of the applying part or less than a holding member side cross-sectional area of the relay porous member, and a clap part is formed between a step part and the relay porous member with a clearance in the range of 0-2 mm.

2. The applicator as described in claim 1, wherein the liquid is a cosmetic composition having a viscosity ranged from 1 to 15 mPa·s.

* * * * *